US008503700B2

(12) United States Patent
Fujise et al.

(10) Patent No.: US 8,503,700 B2
(45) Date of Patent: Aug. 6, 2013

(54) PIEZOELECTRIC ACOUSTIC TRANSDUCER

(75) Inventors: Akiko Fujise, Osaka (JP); Toshiyuki Matsumura, Osaka (JP)

(73) Assignee: Panasonic Corporation, Osaka (JP)

( * ) Notice: Subject to any disclaimer, the term of this patent is extended or adjusted under 35 U.S.C. 154(b) by 3 days.

(21) Appl. No.: 13/265,084

(22) PCT Filed: Feb. 22, 2011

(86) PCT No.: PCT/JP2011/000969
§ 371 (c)(1),
(2), (4) Date: Oct. 18, 2011

(87) PCT Pub. No.: WO2011/105046
PCT Pub. Date: Sep. 1, 2011

(65) Prior Publication Data

US 2012/0057728 A1 Mar. 8, 2012

(30) Foreign Application Priority Data

Feb. 23, 2010 (JP) ..... 2010-036793

(51) Int. Cl.
*H04R 25/00* (2006.01)
*H04R 1/20* (2006.01)

(52) U.S. Cl.
USPC ..... 381/162; 381/345; 381/173

(58) Field of Classification Search
USPC ..... 381/345, 162, 173, 178, 416, 190, 381/150; 310/311, 327
See application file for complete search history.

(56) References Cited

U.S. PATENT DOCUMENTS

| | | | | |
|---|---|---|---|---|
| 6,453,050 | B1 | 9/2002 | Ogura et al. | |
| 7,039,206 | B2 * | 5/2006 | Mellow | 381/190 |
| 8,014,547 | B2 * | 9/2011 | Ogura et al. | 381/190 |
| 2002/0186860 | A1 | 12/2002 | Ogura et al. | |

FOREIGN PATENT DOCUMENTS

| | | |
|---|---|---|
| JP | 63-102599 | 5/1988 |
| JP | 5-9100 | 2/1993 |
| JP | 2001-16692 | 1/2001 |
| JP | 2001-160999 | 6/2001 |
| JP | 2004-350165 | 12/2004 |
| JP | 2005-286690 | 10/2005 |
| JP | 2007-43631 | 2/2007 |
| JP | 3166425 | 3/2011 |

OTHER PUBLICATIONS

International Search Report issued Apr. 19, 2011 in International (PCT) Application No. PCT/JP2011/000969.

* cited by examiner

*Primary Examiner* — Ahmad Matar
*Assistant Examiner* — Norman Yu
(74) *Attorney, Agent, or Firm* — Wenderoth, Lind & Ponack, LLP

(57) ABSTRACT

A piezoelectric speaker includes: a chassis having a wall surface including an opening; a plurality of diaphragms including at least a first piezoelectric diaphragm and second piezoelectric diaphragms which vibrate in phases opposite to each other when a voltage is applied; and a joint member which connects the first and second piezoelectric diaphragms in a positional relationship such that the diaphragms are located at positions different from each other in a thickness direction. One of the diaphragms is provided, in the opening of the chassis, to have one surface facing an outside of the chassis and another surface facing an inside of the chassis. The diaphragm functions as a radiation plate which radiates a sound wave by vibrating at an amplitude generated by synthesizing amplitudes of the first and second piezoelectric diaphragms.

13 Claims, 25 Drawing Sheets

PIEZOELECTRIC ACOUSTIC TRANSDUCER

BACKGROUND OF THE INVENTION

1. Technical Field

The present invention relates to piezoelectric acoustic transducers, and relates more particularly to a piezoelectric acoustic transducer that achieves both compactness and increase in bass reproduction ability.

2. Description of the Related Art

A conventional piezoelectric acoustic transducer (also called as a "piezoelectric speaker") reproduces sound, using: bending deformation of a diaphragm taking advantage of an inverse piezoelectric effect, and a resonance unique to each diaphragm. This has a problem of inferior bass reproduction ability compared to an electrodynamic speaker including a diaphragm having an equivalent area. A means to solve this problem is a piezoelectric speaker including a damper and an edge between a frame and a diaphragm (See, for example, Japanese Unexamined Patent Application Publication No. 2001-160999).

FIG. 28 is an external view of a piezoelectric speaker described in JP 2001-160999. The piezoelectric speaker 10 includes: an outer frame 21, an inner frame 22, a piezoelectric element 30, diaphragms 41, 42, 43, and 44, dampers 51, 52, 53, 54, 55, 56, 57, and 58, and edges 61, 62, 63, and 64. In the piezoelectric speaker 10, when applying an AC (alternating-current) signal in a direction perpendicular to a main surface of the piezoelectric element 30, the piezoelectric element 30 expands or contracts, in the direction of the main surface due to an inverse piezoelectric effect, thus causing bending deformation in the diaphragms 41, 42, 43, and 44. As a result, the piezoelectric speaker 10 generates a sound wave in a direction perpendicular to the main surface of the piezoelectric element 30.

The piezoelectric speaker 10 configured as above includes dampers 51 to 58 and edges 61 and 64, which allows reducing stiffness of a suspension system. Accordingly, the configuration allows reducing the minimum resonance frequency, and thus allows lowering a bass reproduction limit compared to a conventional piezoelectric speaker.

SUMMARY OF THE INVENTION

1. Technical Problem

However, to allow the piezoelectric speaker 10 configured as above to obtain a sufficient volume in bass range, it is necessary to apply a higher voltage so as to increase the amount of expansion and contraction of the piezoelectric element 30. This causes two problems as below. First, applying a higher AC voltage additionally impresses an electric field beyond an electrically allowable input range of the piezoelectric element 30, and this accordingly causes a problem of deterioration in performance of the piezoelectric element 30. Second, a problem of crack fracture arises when an amount of the bending deformation of the piezoelectric element 30 exceeds a critical fracture stress of the piezoelectric material.

Therefore, an object of the present invention is to provide a piezoelectric acoustic transducer capable of reproducing sound of a bass range, with high sound pressure without increasing a voltage to be applied to the piezoelectric element.

2. Solution to the Problem

A piezoelectric acoustic transducer according to an aspect of the present invention includes: a chassis having a wall surface including an opening; a plurality of diaphragms including at least a first piezoelectric diaphragm and a second piezoelectric diaphragm which vibrate in phases opposite to each other when a voltage is applied to each of the first and second piezoelectric diaphragms; and a joint member which connects the first and second piezoelectric diaphragms in a positional relationship such that the first and second piezoelectric diaphragms are located at positions different from each other in a thickness direction. In addition, one of the diaphragms is provided, in the opening of the chassis, to have one surface facing an outside of the chassis and an other surface facing an inside of the chassis, and functions as a radiation plate which radiates a sound wave by vibrating at an amplitude generated by synthesizing amplitudes of the first and second piezoelectric diaphragms.

The configuration described above allows achieving a piezoelectric acoustic transducer capable of reproducing sound of a bass range with high sound pressure, without increasing a voltage to be applied to the piezoelectric element. Note that the radiation plate may be the first piezoelectric diaphragm or another diaphragm that is different from the first or the second piezoelectric diaphragm.

As an example, the first piezoelectric diaphragm may be provided in the opening of the chassis and may function as the radiation plate. In this case, the second piezoelectric diaphragm is housed inside the chassis.

As another example, the diaphragms may include the radiation plate which is connected to the first piezoelectric diaphragm at a position such that the radiation plate is located at a position different from the first piezoelectric diaphragm in the thickness direction, and which vibrates at the synthesized amplitude transmitted from the first piezoelectric diaphragm. In this case, the first and second piezoelectric diaphragms are housed inside the chassis.

In addition, the radiation plate and the first piezoelectric diaphragm may be placed to face each other. Furthermore, the piezoelectric acoustic transducer may include a connection member which connects the radiation plate to the first piezoelectric diaphragm at a point at which an amplitude of the first piezoelectric diaphragm is maximum. This allows efficiently transmitting the vibration of the first and the second piezoelectric diaphragms to the radiation plate.

Furthermore, the piezoelectric acoustic transducer may include a fixing member for fixing the second piezoelectric diaphragm to an inner wall surface of the chassis.

Furthermore, the piezoelectric acoustic transducer may include a fixing member which is extended toward the outside and the inside of the chassis through a space provided in the chassis, and fixes the second piezoelectric diaphragm to a rigid body outside the chassis. This allows preventing the vibration of the first and the second piezoelectric diaphragms from being transmitted to the chassis.

In addition, each of the first and second piezoelectric diaphragms may have an approximately rectangular shape having a long side and a short side. In addition, the joint member may be a long member which extends along the short side of each of the first and second piezoelectric diaphragms, and may connect the short side of the first piezoelectric diaphragm to the short side of the second piezoelectric diaphragm.

In addition, each of the first and second piezoelectric diaphragms may have an approximately rectangular shape. In addition, the joint member may connect each of corner portions of the first piezoelectric diaphragm to a corresponding one of corner portions of the second piezoelectric diaphragms.

In addition, bending rigidity of the joint member may be larger in a direction that intersects with a main surface of the radiation plate than bending rigidity in a main surface direction of the first and second piezoelectric diaphragms. This allows reducing deformation of the joint member which is caused by the vibration of the first and the second piezoelectric diaphragms.

In addition, each of the first and second piezoelectric diaphragms may include: a substrate; and a piezoelectric element which is provided on at least one of a top face and a reverse face of the substrate, and expands or contracts when a voltage is applied to the piezoelectric element. The first and the second piezoelectric diaphragms may be of a bimorph type including piezoelectric elements on both faces of the substrate, or may be of a monomorph type including a piezoelectric element only on one face of the substrate.

In addition, a line for connecting a signal source and the piezoelectric element may be printed on a face of the substrate, on which the piezoelectric element is provided.

In addition, the line may be extended from the signal source to one of the first and second piezoelectric diaphragms via the other of the first and second piezoelectric diaphragms, and may conduct electricity between the piezoelectric element of the first piezoelectric diaphragm and the piezoelectric element of the second piezoelectric diaphragm.

Furthermore, the line may be extended to the one of the first and second piezoelectric diaphragms via the other of the first and second piezoelectric diaphragms, through a through hole that is formed in a surface or inside of the joint member.

Furthermore, the piezoelectric acoustic transducer may include a filling member which is made of a flexible material and fills a space between the radiation plate and the opening of the chassis.

3. Advantageous Effects of the Invention

According to the configuration described above, it is possible to obtain a piezoelectric acoustic transducer which is capable of reproducing sound of a bass range with high sound pressure, without increasing a voltage to be applied to the piezoelectric element.

DETAILED DESCRIPTION OF THE INVENTION

Hereinafter, a piezoelectric speaker according to each embodiment of the present invention will be specifically described with reference to the drawings.

1. Embodiment 1

Figure 1:
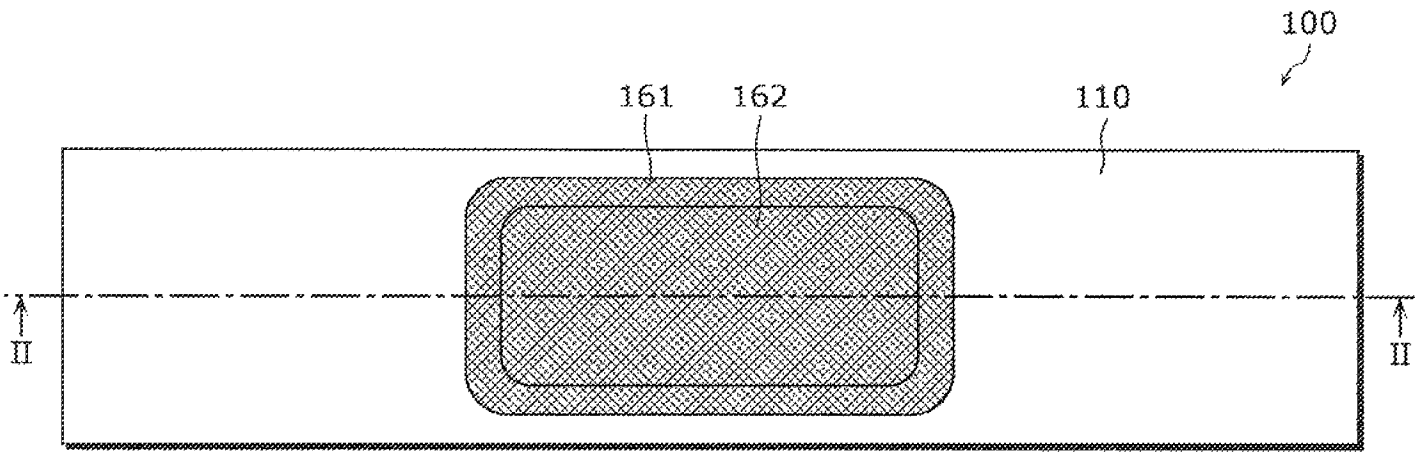
FIG. 1 is a front view of a piezoelectric speaker according to a first embodiment.
Figure 2:
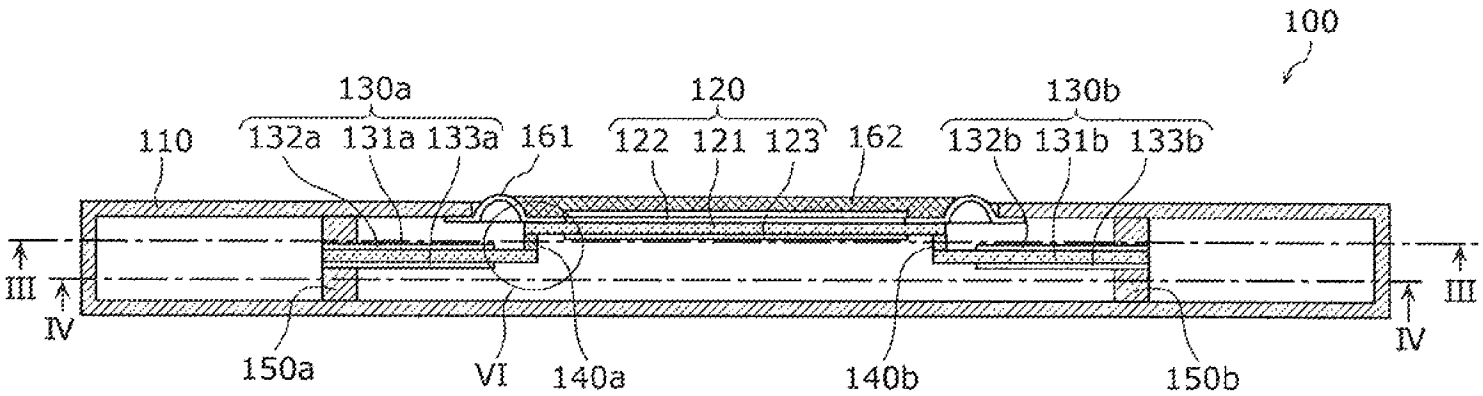
FIG. 2 is a cross-sectional view of a section taken along line II-II in FIG. 1.
Figure 3:
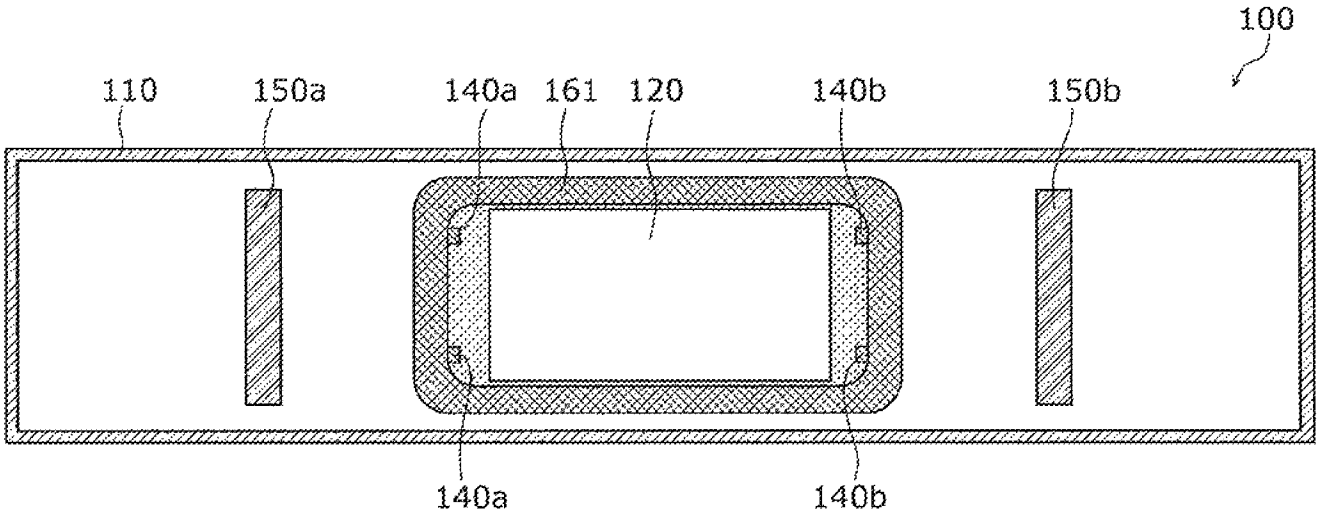
FIG. 3 is a cross-sectional view of a section taken along line III-III in FIG. 2.
Figure 4:
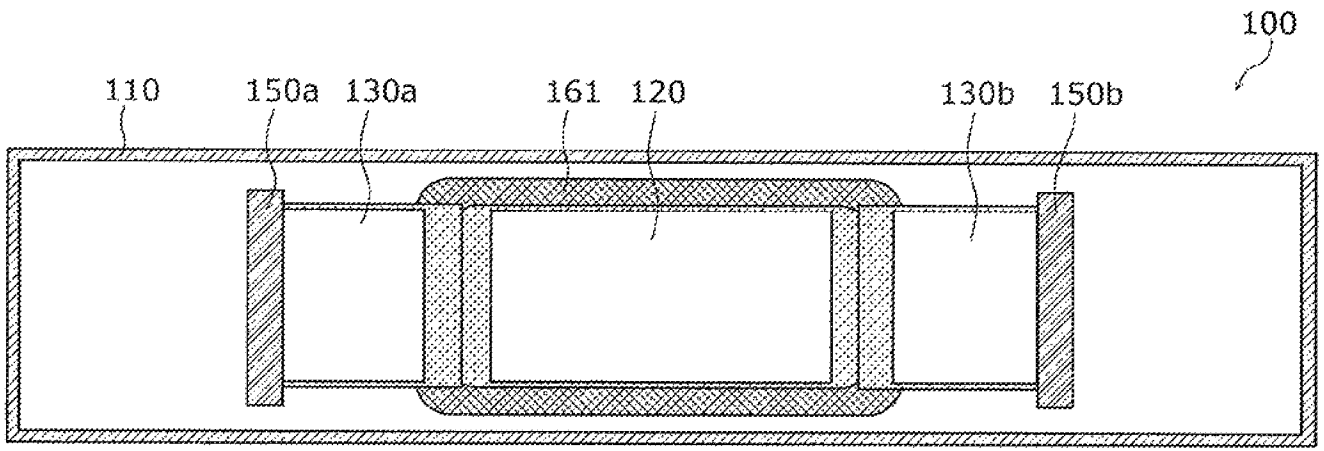
FIG. 4 is a cross-sectional view of a section taken along line IV-IV in FIG. 2.
Figure 5:
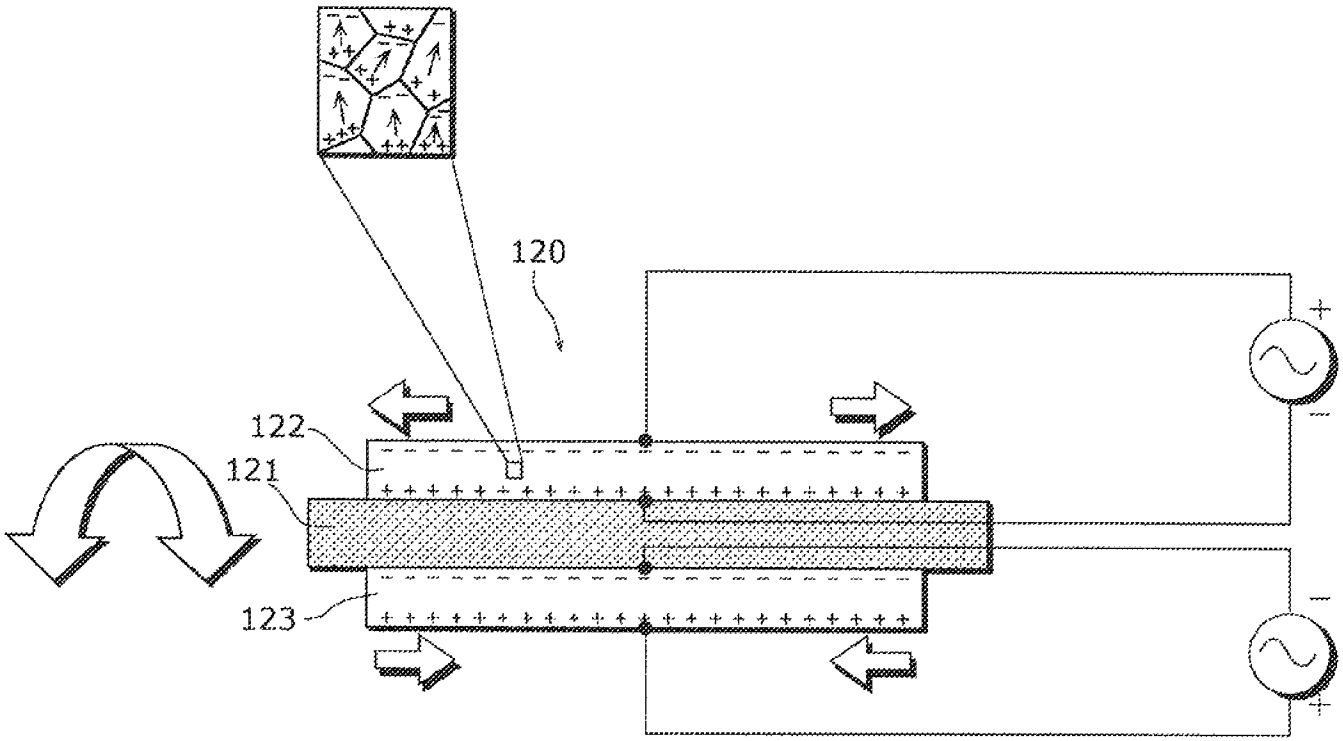
FIG. 5 is an enlarged view of a first piezoelectric diaphragm.
Figure 6:
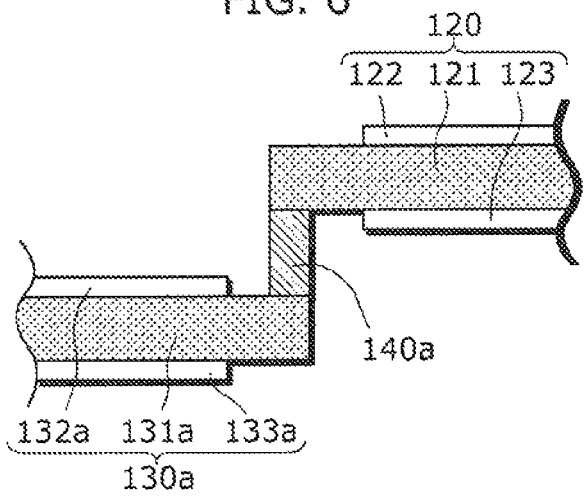
FIG. 6 is an enlarged view of a region VI in FIG. 2.

A piezoelectric speaker 100 according to a first embodiment is described with reference to FIGS. 1 to 6. FIG. 1 is a front view of the piezoelectric speaker 100 according to the first embodiment. FIG. 2 is a cross-sectional view of a section taken along II-II in FIG. 1. FIG. 3 is a cross-sectional view of a section taken along III-III in FIG. 2. FIG. 4 is a cross-sectional view of a section taken along IV-IV in FIG. 2. FIG. 5 is an enlarged view of a first piezoelectric diaphragm 120. FIG. 6 is an enlarged view of a region VI in FIG. 2.

The piezoelectric speaker 100 according to the first embodiment, as shown in FIGS. 1 to 4, mainly includes: a chassis 110, a first piezoelectric diaphragm 120, second piezoelectric diaphragms 130*a* and 130*b*, joint members 140*a* and 140*b*, fixing members 150*a* and 150*b*, an edge 161, and a radiation plate protection film 162. This piezoelectric speaker 100 is bilaterally symmetric with respect to a center line (not shown) in FIG. 2.

The chassis 110 is an approximately-rectangular cuboid having, inside, a space for housing a diaphragm (which is to be described later). In addition, an opening is provided in a front wall surface of the chassis 110. Note that the piezoelectric speaker 100 according to the first embodiment is incorporated in, for example, a flat television and so on, and thus has an extremely small thickness (vertical dimension in FIG. 2) compared to a length or width thereof.

Each of the first piezoelectric diaphragm 120 and the second piezoelectric diaphragms 130*a* and 130*b* is a plate-shaped member that is an approximately rectangle (in an approximately rectangular shape) having a long side and a short side, and functions as a diaphragm which vibrates by application of voltage. Note that for each of the first and second piezoelectric diaphragms 120, 130*a*, and 130*b* according to the first embodiment, an example of a bimorph piezoelectric diaphragm in which piezoelectric elements are mounted on both sides of the substrate is shown; however, in the present invention, a monomorph piezoelectric diaphragm in which the piezoelectric element is mounted on only one side of the substrate may be adopted.

In other words, the first piezoelectric diaphragm 120 includes: a substrate 121, a piezoelectric element 122 attached to a top face of the substrate 121, and a piezoelectric element 123 attached to a bottom face of the substrate 121. Likewise, the second piezoelectric diaphragms 130*a* and 130*b* include, respectively: substrates 131*a* and 131*b*, piezoelectric elements 132*a* and 132*b* attached to the top faces of the substrates 131*a* and 131*b*, and the piezoelectric elements 133*a* and 133*b* attached to the bottom faces of the substrates 131*a* and 131*b*.

A configuration and operation of the first piezoelectric diaphragm 120 are described in detail with reference to FIG. 5. Note that the following description is common to the second piezoelectric diaphragms 130*a* and 130*b*, and therefore the descriptions thereof are omitted.

The substrate 121 is a plate-shaped member and includes a conductive material or an insulating material. Each of the piezoelectric elements 122 and 123 is a plate-shaped member having a polarity that reverses in a direction intersecting with (orthogonal to) the main surface and is made of, for example, ceramics. The example in FIG. 5 shows an uneven distribution of charges in the piezoelectric elements 122 and 123, indicating a negative charge in the top face and a positive charge in the bottom face, and indicating an upward polarization direction. More specifically, as shown by a partially enlarged view of the piezoelectric element 122 in FIG. 5, it is possible to achieve an upward polarization direction as a whole by forming the piezoelectric element 122 such that the charges will be unevenly distributed in each crystal, with the negative charge in the top side and the positive charge in the bottom side. The same is applicable to the piezoelectric element 123.

Each of the top and bottom faces of the piezoelectric elements 122 and 123 is connected to a signal source. In the example in FIG. 5, the connection to the signal source is provided such that a voltage applied to the top and bottom faces reverses between the piezoelectric element 122 and the piezoelectric element 123 Note that FIG. 5 shows two signal sources, but it goes without saying that the two piezoelectric elements 122 and 123 are connected to one signal source.

Lines for connecting the signal source and the piezoelectric elements 122 and 123 may be, for example, printed on the substrate 121. In addition, the lines connected to the piezoelectric elements 122 and 123 may be further extended to the second piezoelectric diaphragms 130*a* and 130*b*. More specifically, a line from the signal source may be extended, via one side of the first and second piezoelectric diaphragms 120, 130*a*, and 130*b*, up to the other side so that the piezoelectric elements 122, 123, 132*a*, 132*b*, 133*a*, and 133*b* conduct electricity between each other.

In the first piezoelectric diaphragm 120 in the above configuration, the piezoelectric element 122 expands in a direction parallel to the main surface (hereinafter, described as a "main surface direction") when a negative voltage is applied to the top side and a positive voltage is applied to the bottom side. On the other hand, the piezoelectric element 123 contracts in the main surface direction when the negative voltage is applied to the top side and the positive voltage is applied to the bottom side. This causes the first piezoelectric diaphragm 120 to bend, with a center portion bulging upward as a whole. On the other hand, when reversing the polarity of the voltage to be applied to each of the piezoelectric elements 122 and 123, the first piezoelectric diaphragm 120 bends with the center portion bulging downward. This causes the first piezoelectric diaphragm 120 to vibrate according to the frequency of the signal source.

In addition, the first piezoelectric diaphragm 120 according to the first embodiment is placed to have one side facing an outside of the chassis 110 and the other side facing an inside of the chassis, and functions as a radiation plate that radiates a sound wave. On the other hand, the second piezoelectric diaphragms 130*a* and 130*b* according to the first embodiment are housed in a space inside the chassis 110.

The joint members 140*a* and 140*b* connect the first piezoelectric diaphragm 120 and the second piezoelectric diaphragms 130*a* and 130*b* in a positional relationship such that the first and the second piezoelectric diaphragms are located at positions different from each other in a thickness direction. Note that it is preferable that the joint members 140*a* and 140*b* have a high Young's modulus and a low density with respect to the substrates 121, 131*a*, and 131*b*.

In the example in FIG. 2, the joint member 140*a* connects a left end of a bottom face of the first piezoelectric diaphragm 120 and a right end of a top face of the second piezoelectric diaphragm 130*a*. Likewise, the joint member 140*b* connects a right end of the bottom face of the first piezoelectric diaphragm 120 and a left end of the top face of the second piezoelectric diaphragm 130*b*. In other words, in the first embodiment, the diaphragms are connected in a positional relationship such that the first piezoelectric diaphragm 120 is displaced toward the front side and the second piezoelectric diaphragm 130*a* is displaced toward the back side.

Note that in the first embodiment, the first piezoelectric diaphragm 120 and the second piezoelectric diaphragms 130*a* and 130*b* are also provided at positions different from each other in the main surface direction (horizontal direction in FIG. 2) such that the first piezoelectric diaphragm 120 and each of the second piezoelectric diaphragms 130*a* and 130*b* face each other only in a portion connected by the joint members 140*a* and 140*b* and do not face in another portion.

In addition, in the example in FIG. 3, the joint members 140*a* and 140*b* are provided at corner portions of the first piezoelectric diaphragm 120. In other words, the joint members 140*a* and 140*b* in the first embodiment connect the corner portions of the first and second piezoelectric diaphragms 120, 130*a*, and 130*b* with each other.

Note that the configuration of the joint member is not limited to the configuration described above but may be, for example, a long (rod-shaped) member that extends along each side of the first and the second piezoelectric diaphragms 120, 130*a*, and 130*b*. In addition, sides of the first and second piezoelectric diaphragms 120, 130*a*, and 130*b* may be connected to each other by such joint members. In this case, it is preferable to connect short sides.

The configuration of the joint member 140*a* and a variation thereof will be described with reference to FIGS. 6 to 8. Note that the following description is common to the joint member 140*b* and therefore the description thereof is omitted.

An end (upper end) of the joint member 140*a* is attached to a portion, to which the piezoelectric element 123 is not attached, in the bottom face of the substrate 121 of the first piezoelectric diaphragm 120. In addition, another end (lower end) of the joint member 140*b* is attached to a portion, to which the piezoelectric element 132*a* is not attached, in the top face of the substrate 131*a* of the second piezoelectric diaphragm 130. The attachment method is not particularly limited, but a fastening means such as a bolt or an adhesive material or the like may be used.

Here, the joint member 140*a* may be configured such that the joint member 140*a* has a larger bending stiffness in a direction that intersects with a main surface of the first piezoelectric diaphragm 120 than a bending stiffness in the main surface direction of the first and the second piezoelectric diaphragms 120 and 130*a*. This allows reducing deformation in the joint member 140*a* which is caused by the vibration of the first and the second piezoelectric diaphragms 120 and 130*a*.

In addition, the lines extended between the first and the second piezoelectric diaphragms 120 and 130*a* as described above may be provided to run through a through hole (not shown) formed in a surface of the joint member 140*a* or inside the joint member 140*a*.

Figure 7:
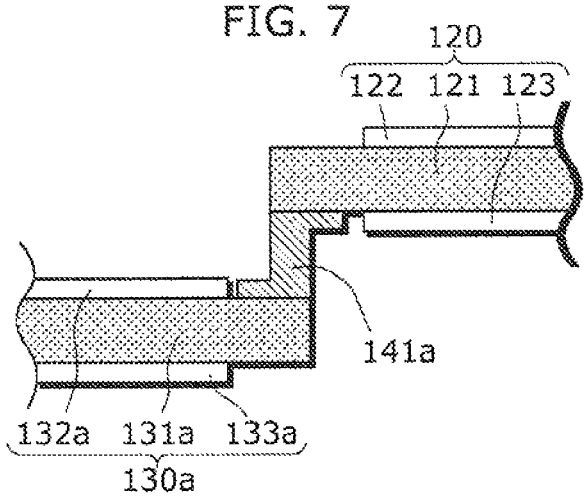
FIG. 7 is a diagram showing a first variation of a joint member.

Next, the joint member 141*a* shown in FIG. 7 has a larger area in a face abutting on the first and the second piezoelectric diaphragms 120 and 130*b* than in a cross-section of a middle portion (indicating a portion between the two abutting faces). This allows further reduction in the deformation of the joint member 141*a* caused by the vibration of the first and the second piezoelectric diaphragms 120 and 130*a*.

Figure 8:
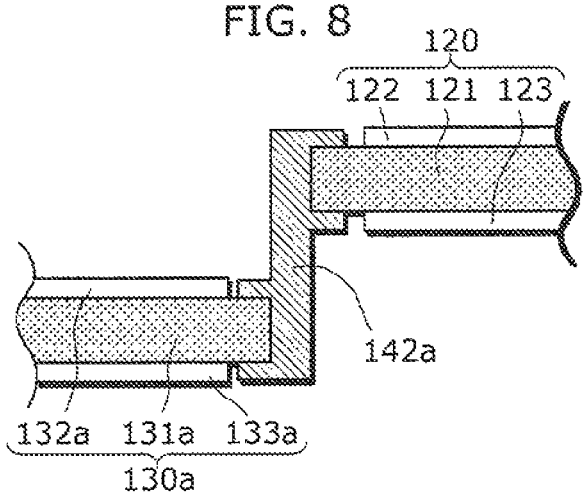
FIG. 8 is a diagram showing a second variation of the joint member.

Furthermore, the joint member 142*a* shown in FIG. 8 includes: in one lateral side (on the right in FIG. 8) in an upper end portion, a slot portion which vertically holds an end portion of the substrate 121 of the first piezoelectric diaphragm 120; and in the other lateral side (on the left in FIG. 8) in a lower end portion, a slot portion which vertically holds an end of the substrate 131*a* of the second piezoelectric diaphragm 130*a*. This allows further reducing the deformation in the joint member 142*a* caused by the vibration of the first and the second piezoelectric diaphragms 120 and 130*a*.

The fixing members 150*a* and 150*b* fix the second piezoelectric diaphragms 130*a* and 130*b*. In the first embodiment, the second piezoelectric diaphragms 130*a* and 130*b* are fixed to an inner wall surface of the chassis 110 by the fixing members 150*a* and 150*b*. Specifically, a left end portion of the second piezoelectric diaphragm 130*a* is fixed to an inner wall surface of the front or back side of the chassis 110 by the fixing member 150*a*. A right end portion of the second piezoelectric diaphragm 130*b* is fixed to an inner wall surface of the front side and the back side of the chassis 110 by the fixing member 150*b*. However, the configuration is not limited to the above, and the second piezoelectric diaphragms 130*a* and 130*b* may be fixed to the inner wall surface of the lateral side of the chassis 110, using the fixing members 150*a* and 150*b*.

The edge 161 functions as a filling member which fills a gap between the opening in the chassis 110 and the first piezoelectric diaphragm 120 which functions as the radiation plate. Specifically, the edge 161 is a frame which follows the shapes of the opening in the chassis 110 and the first piezoelectric diaphragm 120, and whose outer rim portion is attached to a peripheral portion of the opening in the chassis 110, and whose inner rim portion is attached to a peripheral portion of the first piezoelectric diaphragm 120. The material for forming the edge 161 is not particularly limited, but it is preferable to form the edge 161 using, for example, a flexible material such as a lamination material and urethane rubber.

The radiation plate protection film 162 is provided to cover a surface which faces an outside of the chassis 110 and is of the first piezoelectric diaphragm 120, so as to protect the first piezoelectric diaphragm 120 functioning as the radiation plate. The material for forming the radiation plate protection film 162 is not particularly limited, but the same material as the edge 161, for example, may be used.

Figure 9:
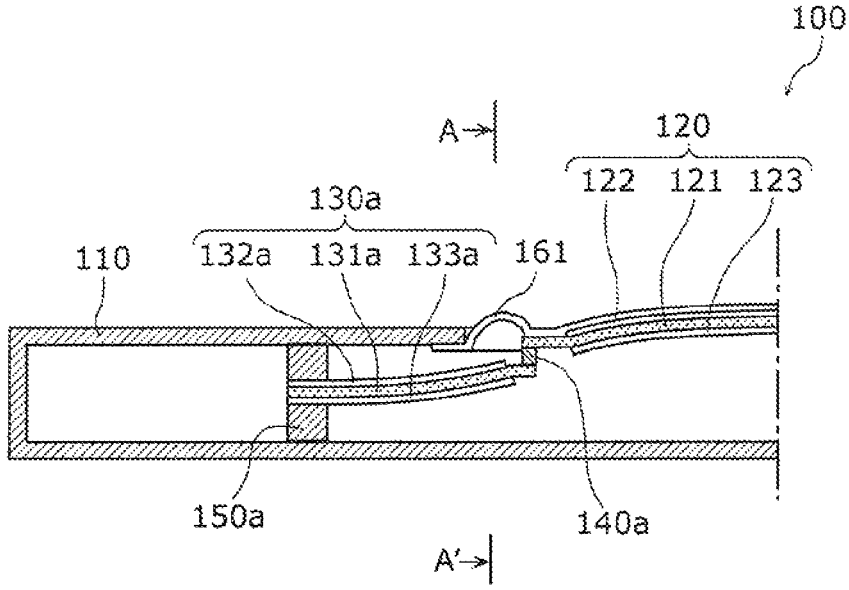
FIG. 9 is an outline cross-sectional view of the first piezoelectric diaphragm when displaced at a maximum level in a radiation direction of a sound wave.
Figure 10:
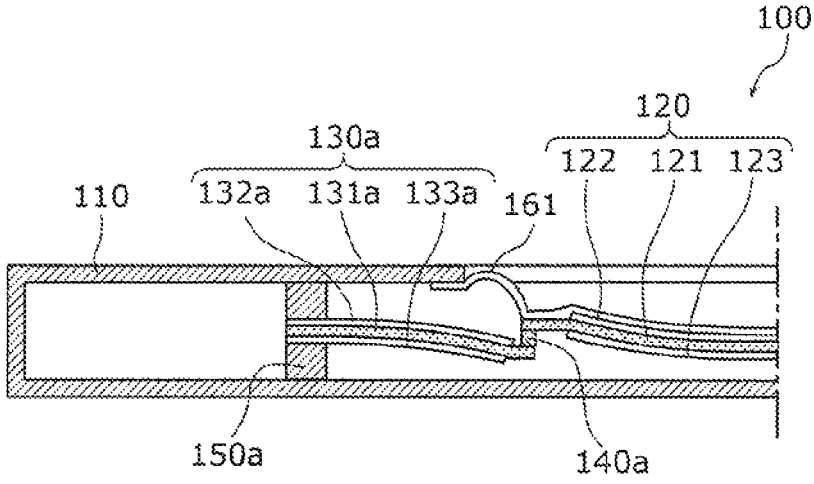
FIG. 10 is an outline cross-sectional view of the first piezoelectric diaphragm when displaced at a maximum level in a direction inverse to the direction of the radiation direction of the sound wave.

The operation of the piezoelectric speaker 100 thus configured is described with reference to FIGS. 9 and 10. FIG. 9 is an outline cross-sectional view of the first piezoelectric diaphragm 120 when displaced at a maximum level in a radiation direction of a sound wave (toward the front side of the chassis 110). FIG. 10 is an outline cross-sectional view of the first piezoelectric diaphragm 120 when displaced at a maximum level in a direction opposite to the radiation direction of the sound wave (toward the back side of the chassis 110). Note that FIGS. 9 and 10 illustrate the piezoelectric speaker 100, omitting the right side from the center of the piezoelectric speaker 100.

When a voltage is applied in order to displace the first piezoelectric diaphragm 120 in the radiation direction of the sound wave, the piezoelectric elements 122 and 133*a* become deformed extending in the main surface direction, and the piezoelectric elements 123 and 132*a* become deformed contracting in the main surface direction. On the other hand, the substrates 121 and 131*a* neither expand nor contract. In other words, the first piezoelectric diaphragm 120 becomes bending-deformed, bulging toward the front side of the chassis 110, and the second piezoelectric diaphragm 130*a* becomes bending-deformed, bulging toward the back side of the chassis 110. As a result, the first and the second piezoelectric diaphragms 120 and 130*a* become bending-deformed as shown in FIG. 9.

On the other hand, when a voltage is applied such that the first piezoelectric diaphragm 120 becomes displaced in the direction opposite to the radiation direction of the sound wave, the piezoelectric elements 122, 123, 132*a*, and 133*a* expand and contract in a direction opposite to the direction in the case shown in FIG. 9. As a result, the piezoelectric elements are bending-deformed as shown in FIG. 10. In other words, the first piezoelectric diaphragm 120 and the second piezoelectric diaphragm 130*a* are bending-deformed in directions opposite to each other.

Here the displacement of the first piezoelectric diaphragm 120 and the edge 161 contributes to a pressure of the sound radiated from the piezoelectric speaker 100. The left end portion of the first piezoelectric diaphragm 120 is connected to the second piezoelectric diaphragm 130*a* via the joint member 140*a*; thus, a displacement at each point on the first piezoelectric diaphragm 120 can be obtained by adding a displacement at a right end of the second piezoelectric diaphragm 130*a* to a displacement caused by the bending deformation of the first piezoelectric diaphragm 120 itself. As a result, the first piezoelectric diaphragm 120 that functions as the radiation plate vibrates at a synthesized amplitude of the first and the second piezoelectric diaphragms 120 and 130*a*, that is, an amplitude larger than each individual amplitude of the first and the second piezoelectric diaphragms 120 and 130*a*.

Accordingly, compared to the case of the piezoelectric speaker 100 including only the first piezoelectric diaphragm 120, it is possible to obtain a larger displacement as a whole, without increasing the bending deformation of the first piezoelectric diaphragm 120 itself. With this, according to the first embodiment, it is possible to reproduce sound with high sound pressure without increasing the voltage applied to each of the piezoelectric elements 122, 123, 132*a*, and 133*a*.

In addition, according to the first embodiment, since the edge 161 made of a flexible material is provided around the first piezoelectric diaphragm 120 that contributes to the sound pressure, it is possible to cause a larger displacement in the first piezoelectric diaphragm 120 while preventing decrease in the sound pressure due to wraparound into the top face, of antiphase sound generated from the bottom face of the first piezoelectric diaphragm 120.

In addition, according to the first embodiment, the first piezoelectric diaphragm 120 and the second piezoelectric diaphragm 130*a* are connected in a direction perpendicular to the main surface via the joint member 140*a*. This, even when the chassis 110 has a smaller inner thickness, allows obtaining a larger displacement while preventing the displaced first and second piezoelectric diaphragms 120 and 130*a* from coming into contact with an inner wall surface of the chassis 110, as compared to the case where the main surfaces of the first and the second piezoelectric diaphragms 120 and 130*a* are located on the same level surface.

In other words, in FIG. 9, it is possible to set the position of the second piezoelectric diaphragm 130*a* in a rear portion, to avoid the piezoelectric element 132*a* from coming into contact with the inner wall surface of the front side of the chassis 110. Likewise, in FIG. 10, it is possible to set the position of the first piezoelectric diaphragm 120 in a front portion to avoid the piezoelectric element 123 from coming into contact with the inner wall surface of the back side of the chassis 110.

As described earlier, the height of the joint member 140*a* for preventing the contact with the inner wall surface of the chassis 110 has an upper limit and a lower limit which are represented by Expression 1 below. Note that in Expression 1, $t_{joint}$ represents a height of the joint member 140*a*, $x_{lower}$ represents a maximum value of a displacement amount at a right end portion of the second piezoelectric diaphragm 130*a*, $x_{lower'}$ represents a maximum value of a displacement amount of the second piezoelectric diaphragm 130*a* at a position (A-A' in FIG. 9) which shares a vertical cross section with an end portion of the edge 161, $x_{upper}$ represents a maximum value of a displacement difference between a left end portion and a center portion of the first piezoelectric diaphragm 120, and $t_c$ is a distance (inner dimension) between the inner wall surface of the front side and the inner surface of the back side of the chassis 110.

(Expression 1)

$$\mathrm{Max}\left(\frac{t_c + x_{lower} + x_{upper}}{2}, x'_{lower}\right) < t_{joint} < t_c - x_{lower} \qquad \text{[Math. 1]}$$

However, each of $x_{lower}$, $x_{lower'}$, and $x_{upper}$ is a value uniquely determined by: an effective vibration area of the piezoelectric speaker 100; a distance between the piezoelectric speaker 100 and a sound receiving point; a mode at a resonance frequency of a minimum order within a reproduction frequency bandwidth of the piezoelectric speaker 100.

In addition, by placing, immediately under the edge 161, a right end portion of the second piezoelectric diaphragm 130*a* and a left end portion of the second piezoelectric diaphragm 130*b*, it is possible to increase the maximum displacement amount in the direction of the sound wave.

Furthermore, according to the first embodiment, the first piezoelectric diaphragm 120 that contributes to the sound pressure receives a pressure difference between an outer space and an inner space of the chassis 110. In contrast, the second piezoelectric diaphragms 130*a* and 130*b* housed inside the chassis 110 can be considered to receive the same pressure from the upper and lower sides of the inner space of the chassis 110. This facilitates reproduction of bass sound despite a narrow chassis capacity, compared to the conventional speaker in which all the diaphragms are influenced by the stiffness of the air in the back of the chassis 110.

2. Embodiment 2

Figure 11:
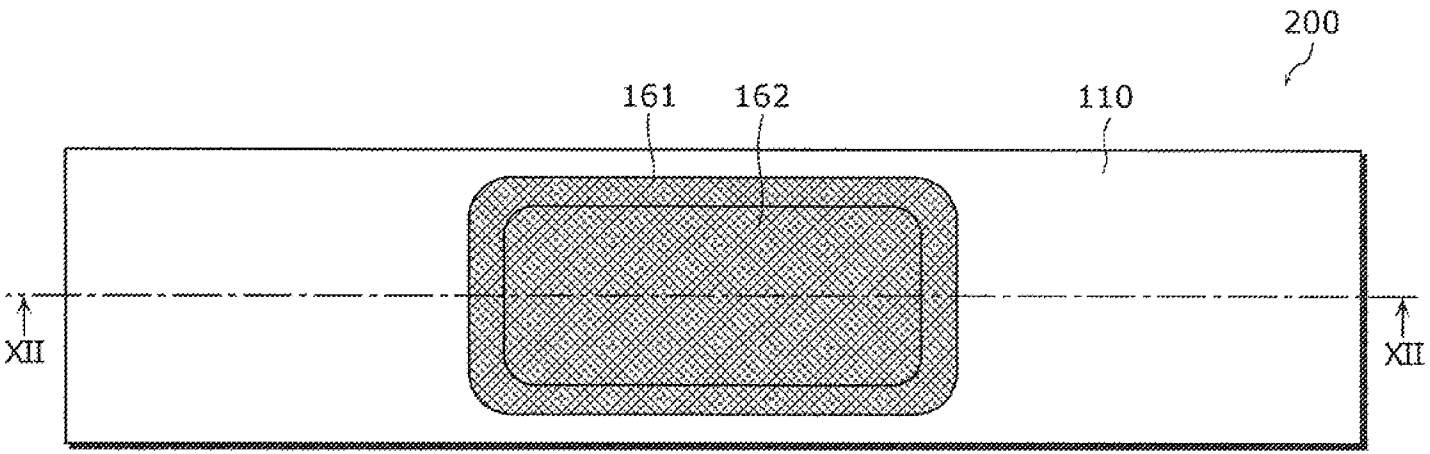
FIG. 11 is a plan view of a piezoelectric speaker according to a second embodiment.
Figure 12:
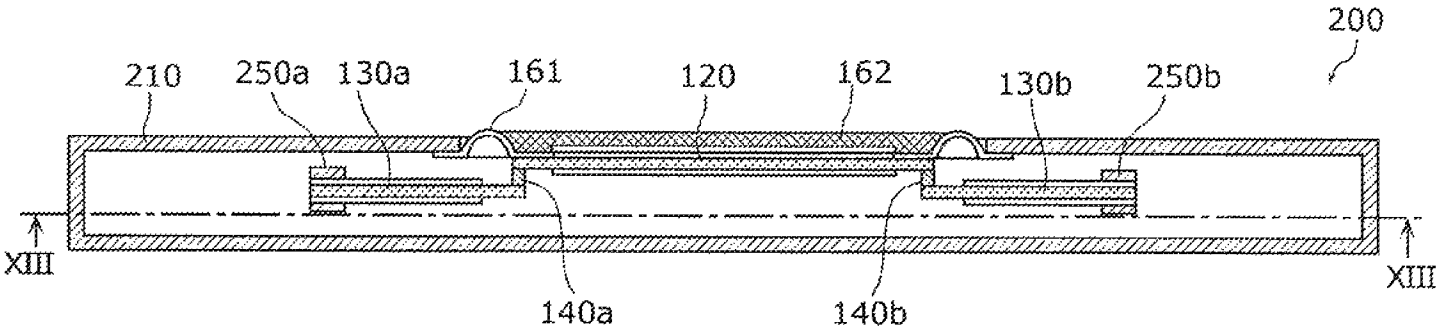
FIG. 12 is a cross-sectional view of a section taken along line XII-XII in FIG. 11.
Figure 13:
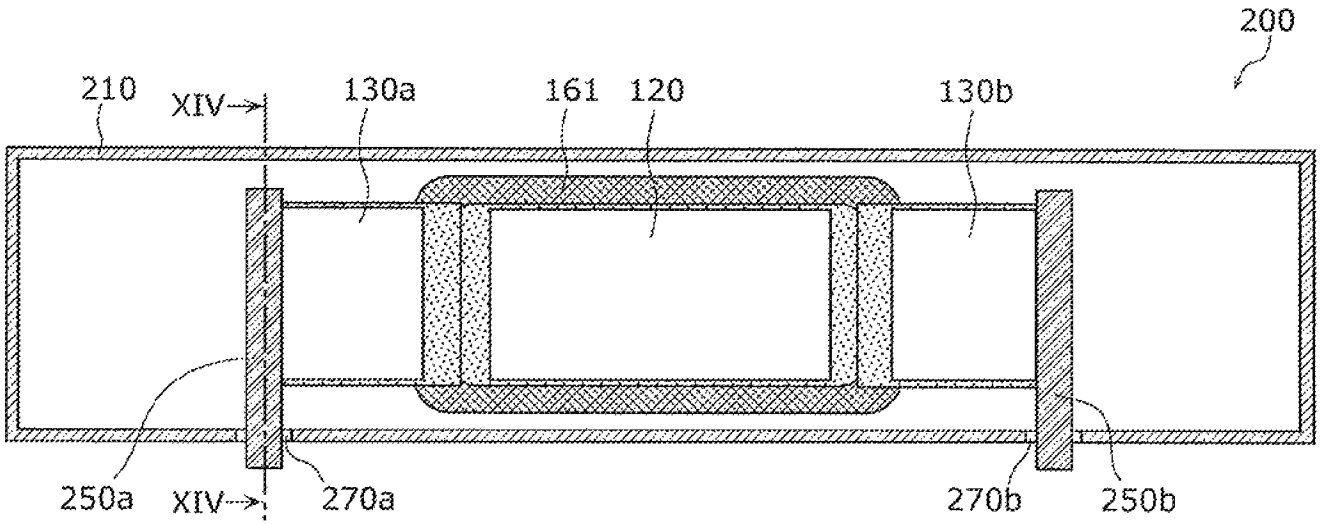
FIG. 13 is a cross-sectional view of a section taken along line XIII-XIII in FIG. 12.
Figure 14:
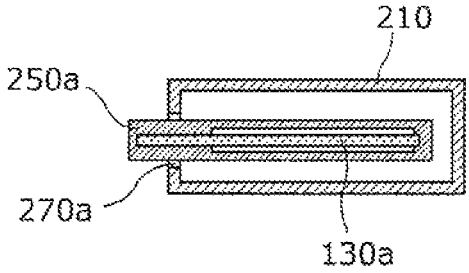
FIG. 14 is a cross-sectional view of a section taken along line XIV-XIV in FIG. 13.

A piezoelectric speaker 200 according to a second embodiment is described with reference to FIGS. 11 to 14. FIG. 11 is a plan view of the piezoelectric speaker 200 according to the second embodiment. FIG. 12 is a cross-sectional view of a section taken along XII-XII in FIG. 11. FIG. 13 is a cross-sectional view of a section taken along XIII-XIII in FIG. 12. FIG. 14 is a cross-sectional view of a section taken along XIV-XIV in FIG. 13.

The piezoelectric speaker 200, as shown in FIGS. 11 to 14, mainly includes: a chassis 210, a first piezoelectric diaphragm 120, second piezoelectric diaphragms 130*a* and 130*b*, joint members 140*a* and 140*b*, fixing members 250*a* and 250*b*, an edge 161, a radiation plate protection film 162, and filling materials 270*a* and 270*b*.

The piezoelectric speaker 200 according to the second embodiment is different from the piezoelectric speaker 100 according to the first embodiment in that the fixing members 250*a* and 250*b* in the piezoelectric speaker 200 are extended toward an outside of the chassis 210 and connected to a device or a base. Hereafter, the description is given focusing on this feature, and the description of a feature common to the piezoelectric speaker 100 according to the first embodiment is principally omitted.

In the second embodiment, the fixing members 250*a* and 250*b* are not directly connected to the chassis 210 but is connected to an external fixing means (rigid body) not shown, through a space (opening) provided in a lateral side of the chassis 210. In addition, in the clearance space (opening) provided in the chassis 210, the filling materials 270*a* and 270*b* are filled between the chassis 210 and the fixing members 250*a* and 250*b*. It is preferable that each of the filling materials 270*a* and 270*b* be a material having a low Young's modulus and a high internal loss.

With the configuration as described above, the chassis 210 and the fixing members 250*a* and 250*b* are structurally independent of each other. Thus, even when the piezoelectric speaker 200 displaces at large amplitude, the chassis 210 is less likely to be influenced by the vibrations of the first and the second piezoelectric diaphragms 120, 130*a* and 130*b*. Thus, according to the second embodiment, it is possible to suppress deterioration in sound quality or generation of abnormal noise that is caused by unnecessary resonance of the chassis 210.

In addition, in the first embodiment, for example, it is necessary to provide the lines from a signal source outside the chassis 110 to the second piezoelectric diaphragms 130*a* and 130*b*, in a through hole provided in the surface or inside of the fixing members 150*a* and 150*b*. On the other hand, in the second embodiment, for example, it is possible to directly connect the signal source and the second piezoelectric diaphragms 130*a* and 130*b* by extending the substrates 131*a* and 131*b* of the second piezoelectric diaphragms 130*a* and 130*b* up to a portion extended toward the outside of the chassis 210. As a result, it is possible to expect an effect of reducing the number of components. Note that in both cases of the first and second embodiments, the line leading to the first piezoelectric diaphragm 120 may be provided to run from the signal source via the second piezoelectric diaphragms 130*a* and 130*b*.

3. Embodiment 3

Figure 15:
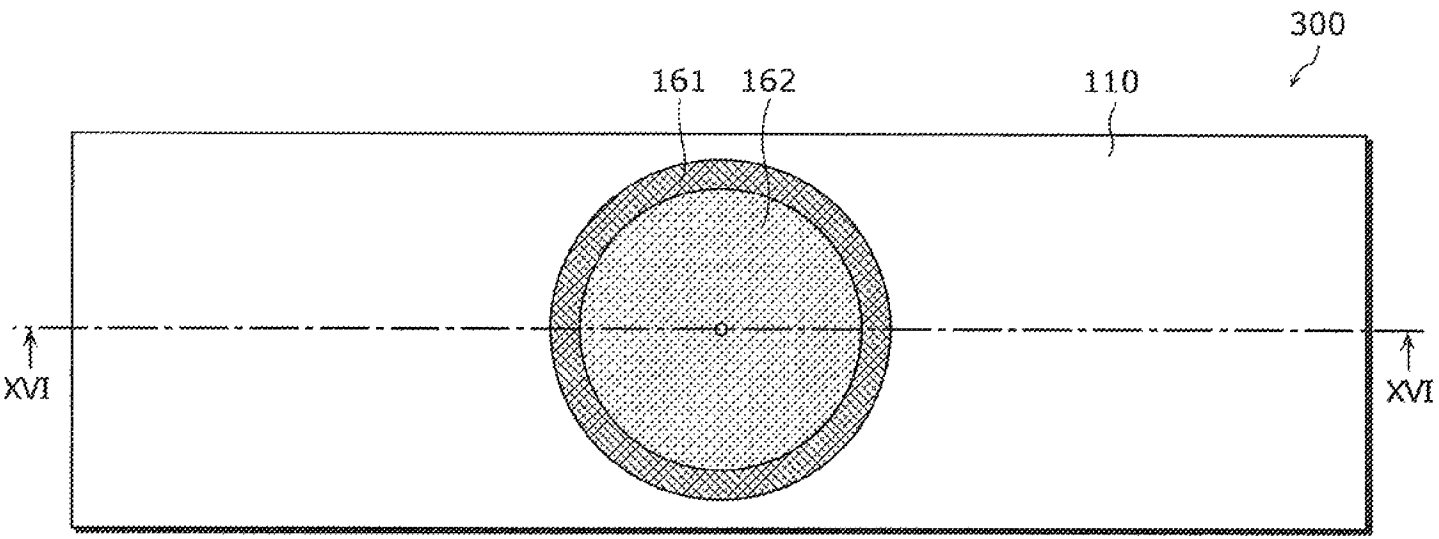
FIG. 15 is a front view of a piezoelectric speaker according to a third embodiment.
Figure 16A:
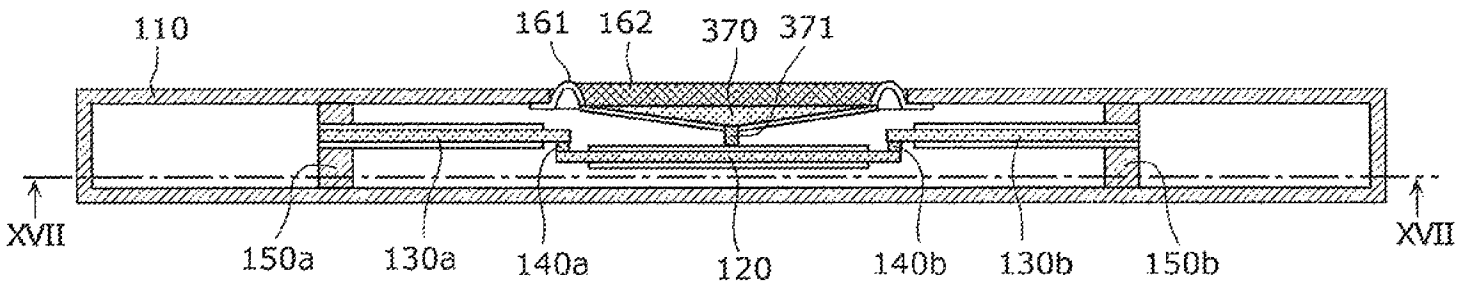
FIG. 16A is a cross-sectional view of a section taken along line XVI-XVI in FIG. 16A.
Figure 16B:
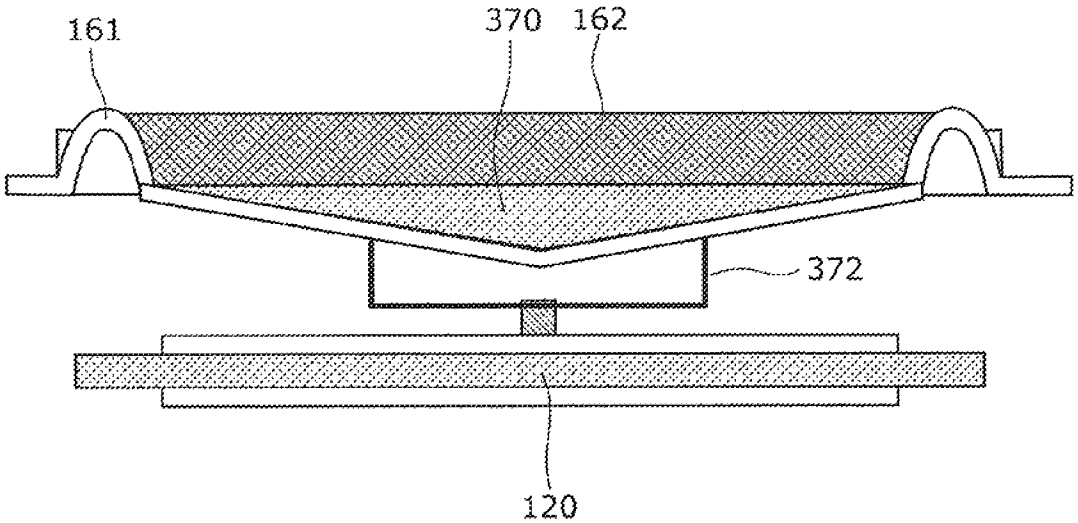
FIG. 16B is a diagram showing another form of a connection member according to the third embodiment.
Figure 17:
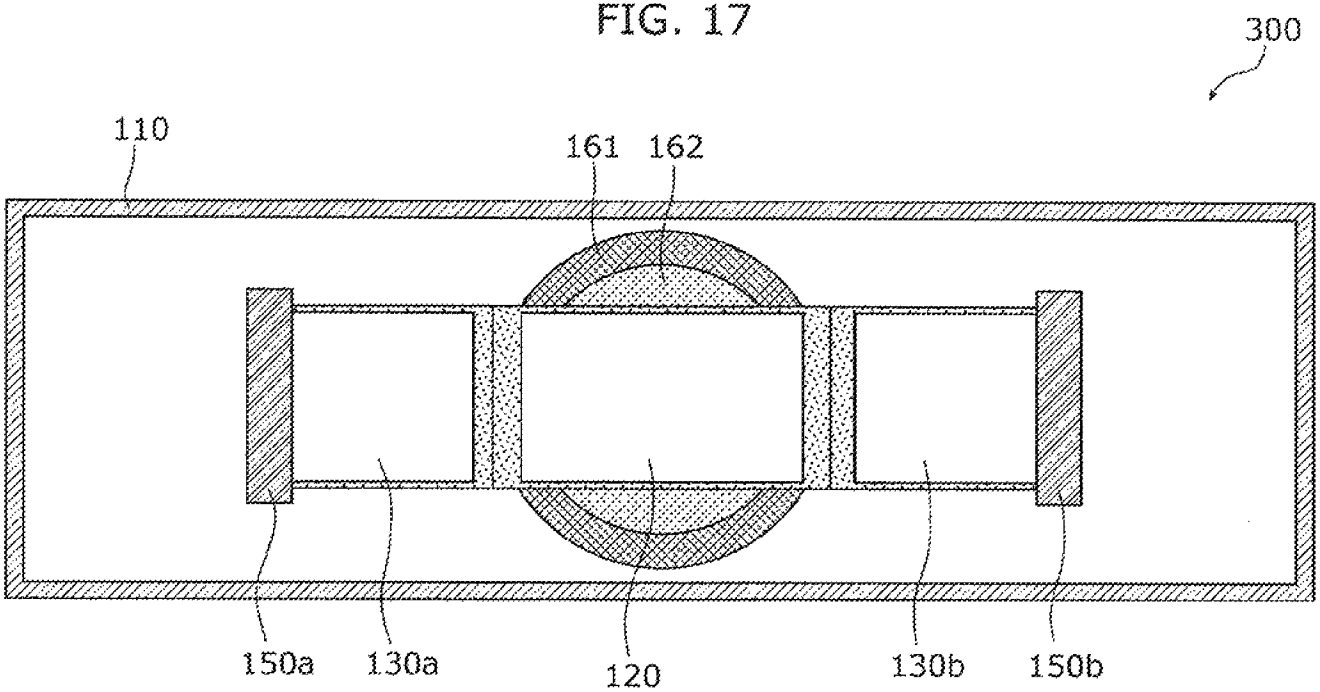
FIG. 17 is a cross-sectional view of a section taken along line XVII-XVII in FIG. 16A.

A piezoelectric speaker 300 according to a third embodiment is described with reference to FIGS. 15 to 17. FIG. 15 is a front view of the piezoelectric speaker 300 according to the third embodiment. FIG. 16A is a cross-sectional view of a section taken along XVI-XVI in FIG. 15. FIG. 16B is a diagram showing another form of the connection member. FIG. 17 is a cross-sectional view of a section taken along XVI-XVI in FIG. 16A.

The piezoelectric speaker 300, as shown in FIGS. 15 to 17, mainly includes: a chassis 110, a first piezoelectric diaphragm 120, second piezoelectric diaphragms 130*a* and 130*b*, joint members 140*a* and 140*b*, fixing members 150*a* and 150*b*, an edge 161, a radiation plate protection film 162, a diaphragm 370, and a connection member 371.

The piezoelectric speaker 300 according to the third embodiment is different from the piezoelectric speaker 100 according to the first embodiment in that: in the piezoelectric speaker 300, the diaphragm 370 having a conical shape and not including a piezoelectric element is connected to the first piezoelectric diaphragm 120 via the connection material 371. This diaphragm 370 is used as a radiation plate that functions as a sound wave radiating surface. Hereafter, the description is given focusing on this feature, and the description of a feature common to the piezoelectric speaker 100 according to the first embodiment is principally omitted.

The diaphragm 370 does not include any piezoelectric element and is approximately conical in shape. In other words, unlike the first and the second piezoelectric diaphragms 120, 130*a*, and 130*b*, the diaphragm 370 cannot generate vibration in itself. Thus, the diaphragm 370 is provided at the opening of the chassis 110 and connected to the first piezoelectric diaphragm 120 via the connection member 371.

More specifically, the diaphragm 370 and the first piezoelectric diaphragm 120 are provided to face each other, and are connected to each other by the connection member 371. In one form, as shown in FIG. 16A, the connection member 371 connects center portions (more preferably, the centers) in the surfaces facing each other, of the diaphragm 370 and the piezoelectric diaphragm 120.

The amplitude of the first piezoelectric diaphragm 120 is maximum in the center portion. Thus, it is possible to efficiently transmit the vibration of the first piezoelectric diaphragm 120 to the diaphragm 370 by connecting the connection member 371 to the center portion at which the amplitude of the first piezoelectric diaphragm 120 is maximum.

In addition, when the connection member 371 is attached to a position off the center portion of the diaphragm 370, shaking is likely to be caused in a direction other than a vibration direction (vertical direction in FIG. 16A), due to biased drive force. Thus, to prevent the generation of such shaking, it is preferable to connect the connection member 371 to the center portion of the diaphragm 370.

For another form, as shown in FIG. 16B, the connection member 372 connects the center portion of the first piezoelectric diaphragm 120 and a circumferential region that is of the diaphragm 370 and is equidistant from the center of the diaphragm 370. For example, as shown in FIG. 16A, in the case of the connection member 371 virtually having a point-contact with a point in the center portion of the diaphragm 370, phase interference is likely to be caused due to separate vibrations. Thus, as shown in FIG. 16B, of the connection member 372, a side that is to face the diaphragm 370 is formed in a cylindrical shape so as to substantially have a line-contact with the diaphragm 370 at a position equidistant from the center of the diaphragm 370, thus effectively preventing phase interference caused by separate vibrations. Note that it is preferable to attach the connection member 372 at a position at which phase interference is least likely to be caused due to the separate vibrations of the diaphragm 370, that is, at a node in the vibration mode.

Note that the diaphragm 370 should preferably have higher rigidity and lower density than those of the first and the second piezoelectric diaphragms 120, 130*a*, and 130*b*. The first piezoelectric diaphragm 120 and the second piezoelectric diaphragms 130*a* and 130*b*, as with the piezoelectric speaker 100 according to the first embodiment, cause bending deformation in directions opposite to each other. On the other hand, the first piezoelectric diaphragm 120 according to the third embodiment is housed in the chassis 110, at a point displaced toward the back side with respect to the second piezoelectric diaphragms 130*a* and 130*b*. In other words, a positional relationship between the first piezoelectric diaphragm 120 and the second piezoelectric diaphragms 130*a* and 130*b* is opposite to the positional relationship in the piezoelectric speaker 100 according to the first embodiment.

In addition, in the first embodiment, the edge 161 is attached around the first piezoelectric diaphragm 120 including the piezoelectric elements 122 and 123, but in the third embodiment, the edge 161 is attached around the diaphragm 370 located at the opening of the chassis 110.

According to the third embodiment, the diaphragm 370 is used as a sound wave radiation region, by connecting the diaphragm 370 that includes no piezoelectric element, to a position at which the displacement in the bass range is maximum in the first and the second piezoelectric diaphragms 120, 130*a*, and 130*b* (that is, the center portion of the first piezoelectric diaphragm 120). This allows causing a large displacement in the entire radiation region, thus efficiently obtaining sound pressure. In addition, compared to the case of using the first piezoelectric diaphragm 120 as the sound wave radiation region, it is possible to reduce the bending deformation of the sound wave radiation region to an extremely small level. This is less likely to cause, even at high frequency, phase interference due to the separate vibrations of the first piezoelectric diaphragm 120, thus preventing deterioration in sound quality.

4. Embodiment 4

Figure 18:
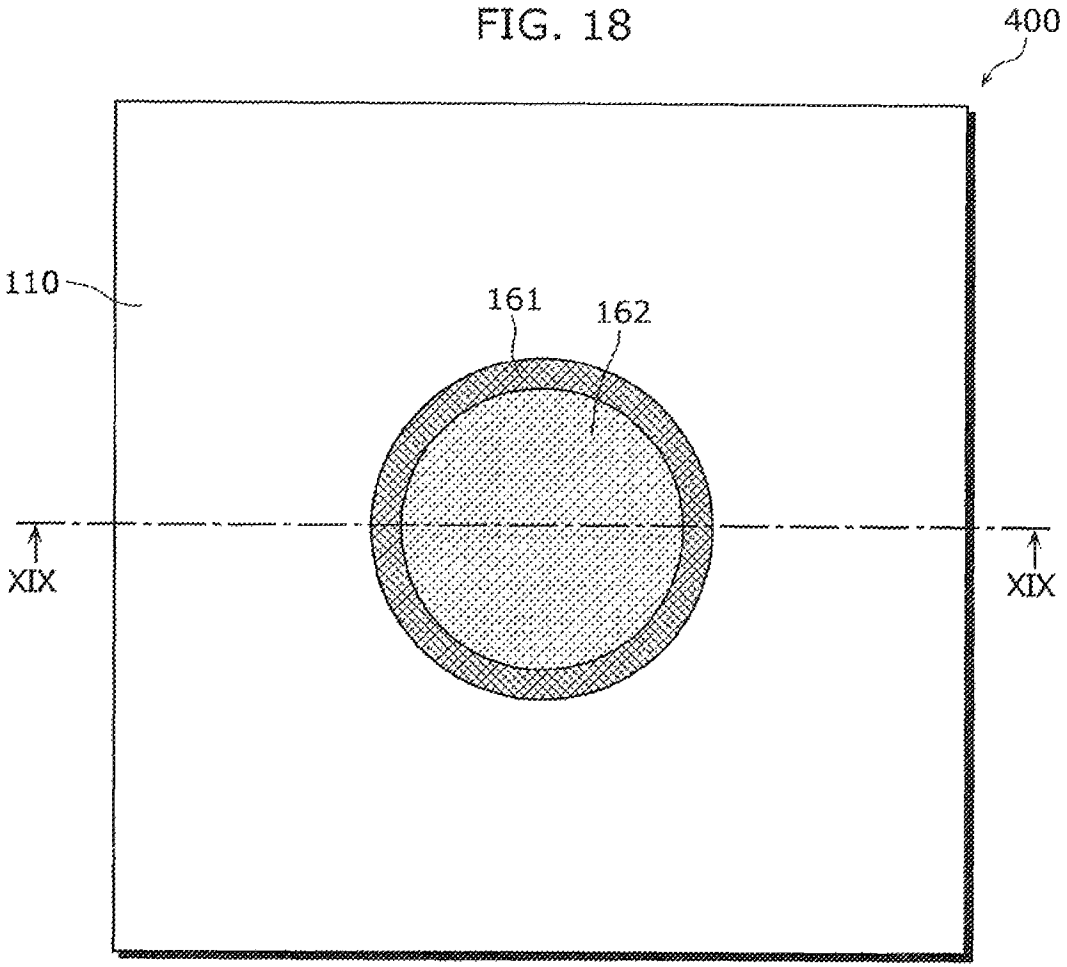
FIG. 18 is a front view of a piezoelectric speaker according to a fourth embodiment.
Figure 19:
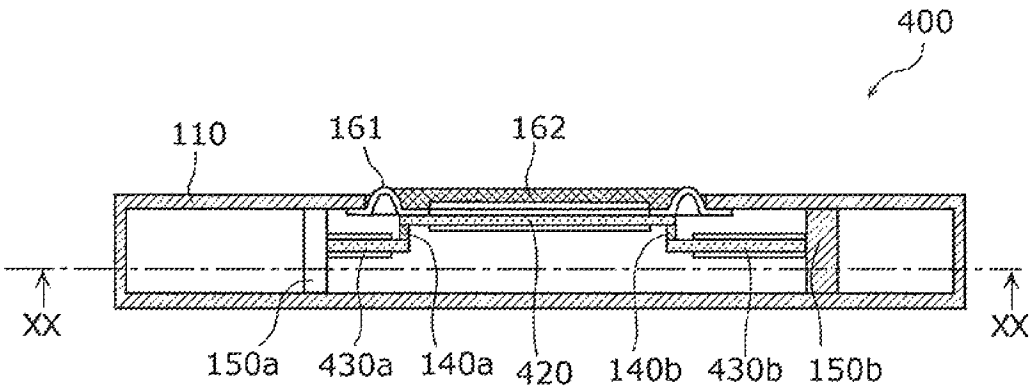
FIG. 19 is a cross-sectional view of a section taken along line XIX-XIX in FIG. 18.
Figure 20:
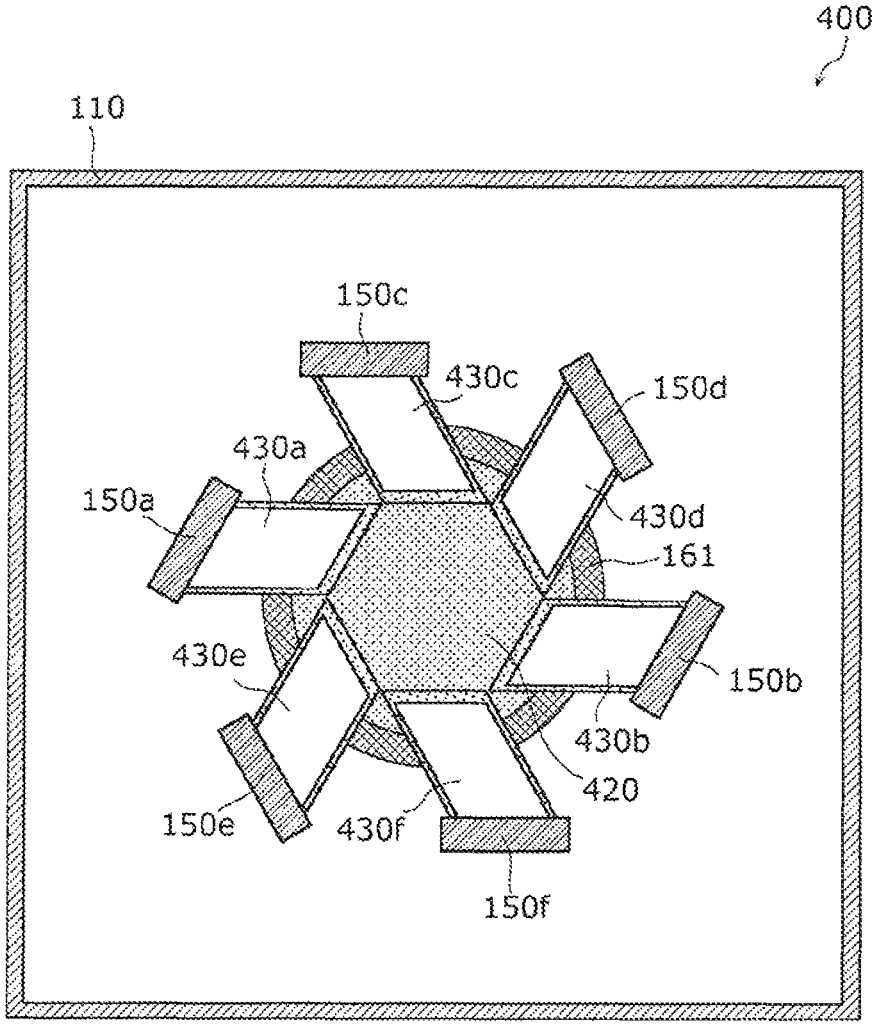
FIG. 20 is a cross-sectional view of a section taken along line XX-XX in FIG. 19.

A piezoelectric speaker 400 according to a fourth embodiment is described with reference to FIGS. 18 to 20. FIG. 18 is a front view of the piezoelectric speaker 400 according to the fourth embodiment. FIG. 19 is a cross-sectional view of a section taken along XIX-XIX in FIG. 18. FIG. 20 is a cross-sectional view of a section taken along XX-XX in FIG. 19.

The piezoelectric speaker 400, as shown in FIGS. 18 to 20, mainly includes: a chassis 110, a first piezoelectric diaphragm 420, second piezoelectric diaphragms 430*a* to 430*f*, joint members 140*a* to 140*f* (only 140*a* and 140*b* are shown), fixing members 150*a* to 150*f*, an edge 161, and a radiation plate protection film 162.

The piezoelectric speaker 400 according to the fourth embodiment is different from the piezoelectric speaker 100 according to the first embodiment in that: in the piezoelectric speaker 400, of the first and the second piezoelectric diaphragms 420 and 430*a* to 430*f*, the first piezoelectric diaphragm 420 which functions as the sound wave radiating surface is formed in a circular shape, and the second piezoelectric diaphragms 430*a* to 430*f* housed in the chassis 110 are arranged radially along a circumference of the first piezoelectric diaphragm 420. Hereafter, the description is given focusing on this feature, and the description of a feature common to the piezoelectric speaker 100 according to the first embodiment is principally omitted.

In the fourth embodiment, to a circumferential portion of the first piezoelectric diaphragm 420 that functions as the sound wave radiating surface, the six second piezoelectric diaphragms 430*a* to 430*f* are connected via the joint members 140*a* to 140*f*.

According to the fourth embodiment, by forming the first piezoelectric diaphragm 420 which functions as the sound wave radiating surface in a circular form, it is possible to approximate the bending deformation to a symmetry with respect to a sound wave radiation axis. This extends, to a higher frequency, an upper limit of the frequency range in which the piezoelectric speaker 400 can be regarded as a point sound source, thus facilitating the control, through signal input, for the speaker which realizes desired sound field characteristics.

5. Embodiment 5

Figure 21:
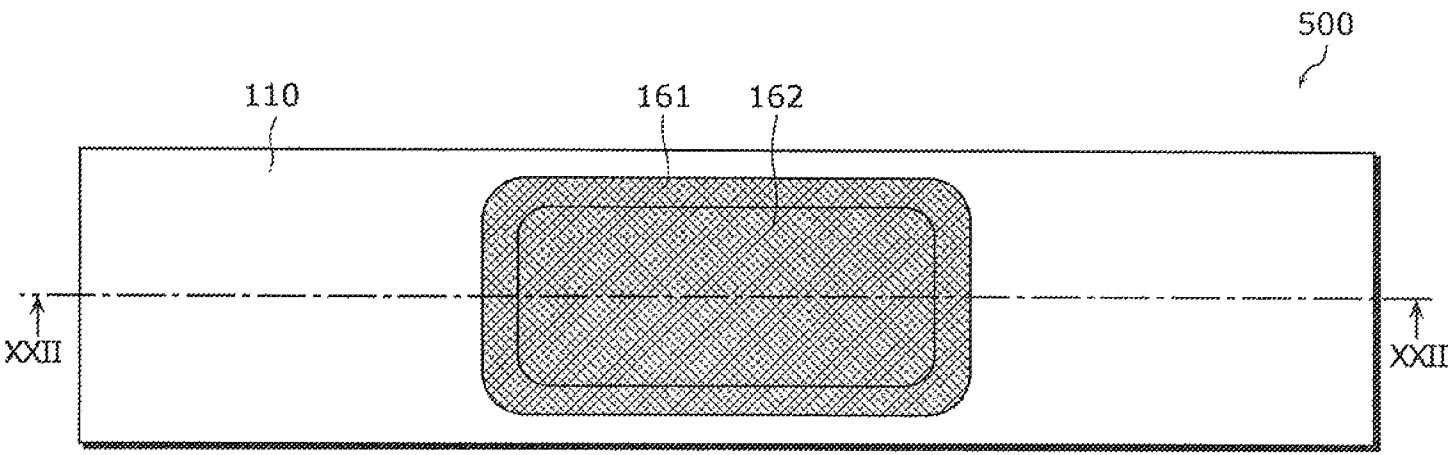
FIG. 21 is a front view of a piezoelectric speaker according to a fifth embodiment.
Figure 22:
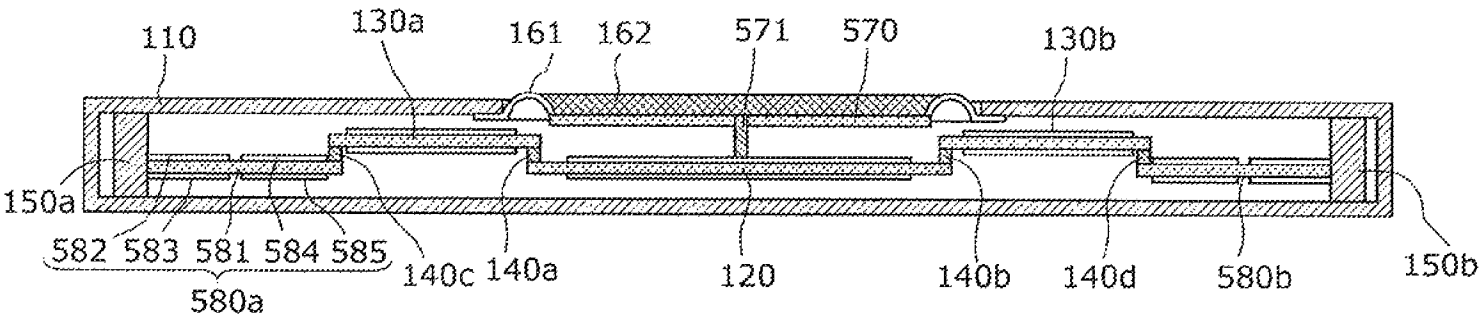
FIG. 22 is a cross-sectional view of a section taken along line XXII-XXII in FIG. 21.

A piezoelectric speaker 500 according to a fifth embodiment is described with reference to FIGS. 21 and 22. FIG. 21 is a front view of the piezoelectric speaker 500 according to the fifth embodiment. FIG. 22 is a cross-sectional view of a section taken along XXII-XXII in FIG. 21.

The piezoelectric speaker 500, as shown in FIGS. 21 and 22, mainly includes: a chassis 110, a first piezoelectric diaphragm 120, second piezoelectric diaphragms 130*a* and 130*b*, third piezoelectric diaphragms 580*a* and 580*b*, joint members 140*a* to 140*d*, fixing members 150*a* and 150*b*, a diaphragm 570, a connection member 571, an edge 161, and a radiation plate protection film 162.

The piezoelectric speaker 500 according to the firth embodiment is different from the piezoelectric speaker 100 according to the first embodiment in that: in the piezoelectric speaker 500, the diaphragm 570 having an approximately rectangular plate-like shape and not including a piezoelectric element is connected to the first piezoelectric diaphragm 120 via the joint member 571, and the piezoelectric speaker 500 includes the third piezoelectric diaphragms 580*a* and 580*b*. Hereafter, the description is given focusing on this feature, and the description of a feature common to the piezoelectric speaker 100 according to the first embodiment is principally omitted.

In the fifth embodiment, the edge 161 is connected around the diaphragm 570 having an approximately rectangular shape and not including a piezoelectric element. Furthermore, the diaphragm 570 and the first piezoelectric diaphragm 120 are connected at a center portion of each other, by the connection member 571.

An end portion of the first piezoelectric diaphragm 120 is connected to each of the second piezoelectric diaphragms 130*a* and 130*b* via the joint members 140*a* and 140*b*. Furthermore, the second piezoelectric diaphragms 130*a* and 130*b* are connected to the third piezoelectric diaphragms 580*a* and 580*b* via the joint members 140*c* and 140*d*.

The third piezoelectric diaphragm 580*a* includes: a substrate 581, and four piezoelectric elements 582, 583, 584, and 585. More specifically, in a left region of the substrate 581, a piezoelectric element 582 is attached to a top surface, and the piezoelectric element 583 is attached to a bottom surface. On the other hand, in a right region of the substrate 581, a piezoelectric element 584 is attached to the top surface, and the piezoelectric element 585 is attached to the bottom surface. Then, a voltage is applied to the third piezoelectric diaphragm 580*a* so as to cause bending deformation in the left region and the right region, in directions opposite to each other. Note that the third piezoelectric diaphragm 580*b* has a common configuration, and thus the description thereof is omitted.

According to the fifth embodiment, by arranging the first, the second, and the third piezoelectric diaphragms 120, 130*a*, 130*b*, 580*a*, and 580*b* so as to cause bending deformation in adjacent diaphragms, in directions opposite to each other, it is possible to ensure a displacement at a significant level as a whole, without increasing bending deformation in each diaphragm.

In addition, the third piezoelectric diaphragms 580*a* and 580*b* located closer to the fixing members 150*a* and 150*b* are configured, without provision of the joint member, such that bending deformation is caused in the right and left regions, in directions opposite to each other. On the other hand, by connecting, using the joint members 140*a* to 140*d*, the first piezoelectric diaphragm 120 that is located farthest from the fixing members 150*a* and 150*b* and displaces at a significant level and the second piezoelectric diaphragms 130*a* and 130*b*, it is possible to effectively prevent the first and the second piezoelectric diaphragms 120, 130*a*, and 130*b* from coming into contact with an inner wall surface of the chassis 110 even when the chassis 110 has a small internal dimension.

6. Embodiment 6

Figure 23:
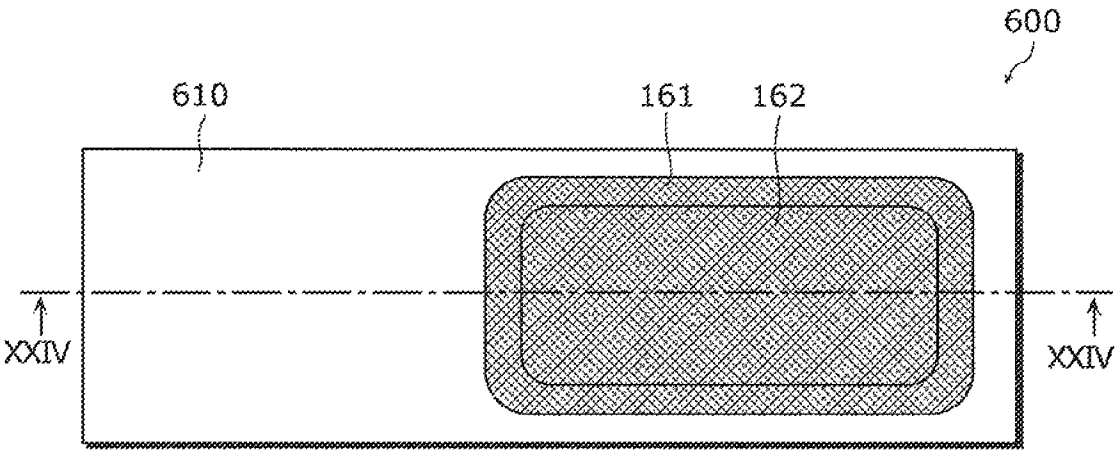
FIG. 23 is a front view of a piezoelectric speaker according to a sixth embodiment.
Figure 24:
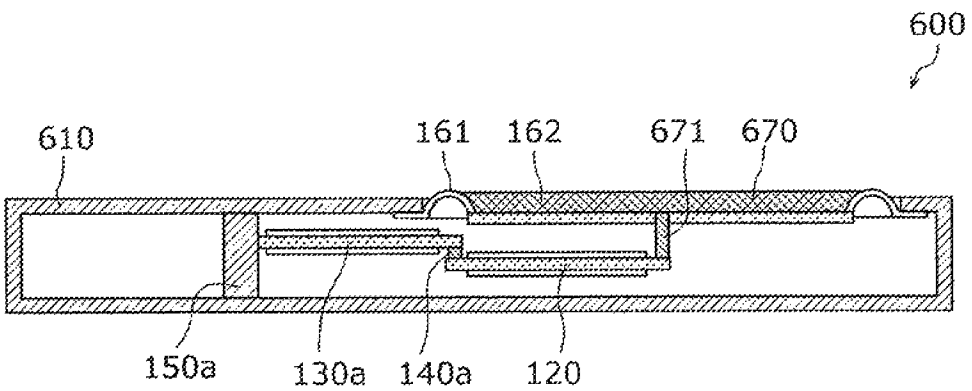
FIG. 24 is a cross-sectional view of a section along line XXIV-XXIV in FIG. 23.

A piezoelectric speaker 600 according to a sixth embodiment is described with reference to FIGS. 23 and 24. FIG. 23 is a front view of the piezoelectric speaker 600 according to the sixth embodiment. FIG. 24 is a cross-sectional view of a section taken along XXIV-XXIV in FIG. 23.

The piezoelectric speaker 600, as shown in FIGS. 23 and 24, mainly includes: a chassis 610, a first piezoelectric diaphragm 120, a second piezoelectric diaphragm 130*a*, a joint member 140*a*, a fixing member 150*a*, an edge 161, a radiation plate protection film 162, a diaphragm 670, and a connection member 671.

The piezoelectric speaker 600 according to the sixth embodiment is different from the piezoelectric speaker 100 according to the first embodiment in that: in the piezoelectric speaker 600, the diaphragm 670 having an approximately rectangular plate-like shape and not including a piezoelectric element is connected to the first piezoelectric diaphragm 120 via a joint member 671; and the second piezoelectric diaphragm 130*a* is attached to only one side of the first piezoelectric diaphragm 120. Hereafter, the description is given focusing on this feature, and the description of a feature common to the piezoelectric speaker 100 according to the first embodiment is principally omitted.

The edge 161 is connected around the diaphragm 670 having an approximately rectangular shape and not including the piezoelectric element. In addition, since the amplitude of the first piezoelectric diaphragm 120 that is a cantilever diaphragm becomes maximum at a right end portion, the connection member 671 connects a center portion of the diaphragm 670 and the right end portion of the first piezoelectric diaphragm 120. In addition, the left end portion of the first piezoelectric diaphragm 120 is connected to the second piezoelectric diaphragm 130*a* via the joint member 140*a*.

Furthermore, the left end portion of the second piezoelectric diaphragm 130*a* is fixed to the inner wall surface of the front side and the back side of the chassis 610 via the fixing member 150*a*.

Here, the diaphragm 670 displaces in a radial direction of the sound wave only due to the deformation of the first and the second piezoelectric diaphragms 120 and 130*a*. When this happens, assuming that both the first and the second piezoelectric diaphragms 120 and 130*a* deform in the same direction, the right end portion of the first piezoelectric diaphragm 120 has a tilt due to warping deformation. This is likely to cause, in the diaphragm 670 connected to the current position, a tilt or shake in either the right or left direction, thus resulting in a possibility of causing a problem of not being able to achieve a parallel displacement in the sound wave radiation direction.

In contrast, since the first and the second piezoelectric diaphragms 120 and 130*a* in the piezoelectric speaker 600 bend in directions opposite to each other, no significant tilt is caused in the right end portion of the first piezoelectric diaphragm 120. As described above, the piezoelectric speaker 600 according to the sixth embodiment can cause a large displacement, even under the condition of the limited number of components, without generating an asymmetric vibration in the sound wave radiating surface.

In other words, in the piezoelectric speaker according to the present invention, as in the first embodiment, the plurality of second piezoelectric diaphragms 130*a* and 130*b* may be connected to the first piezoelectric diaphragm 120, or as in the sixth embodiment, only one second piezoelectric diaphragm 130*a* may be connected to the first piezoelectric diaphragm 120.

Next, in seventh and eighth embodiments, application examples of the piezoelectric speaker according to the present invention as described above will be described.

7. Embodiment 7

First Application Example

Figure 25:
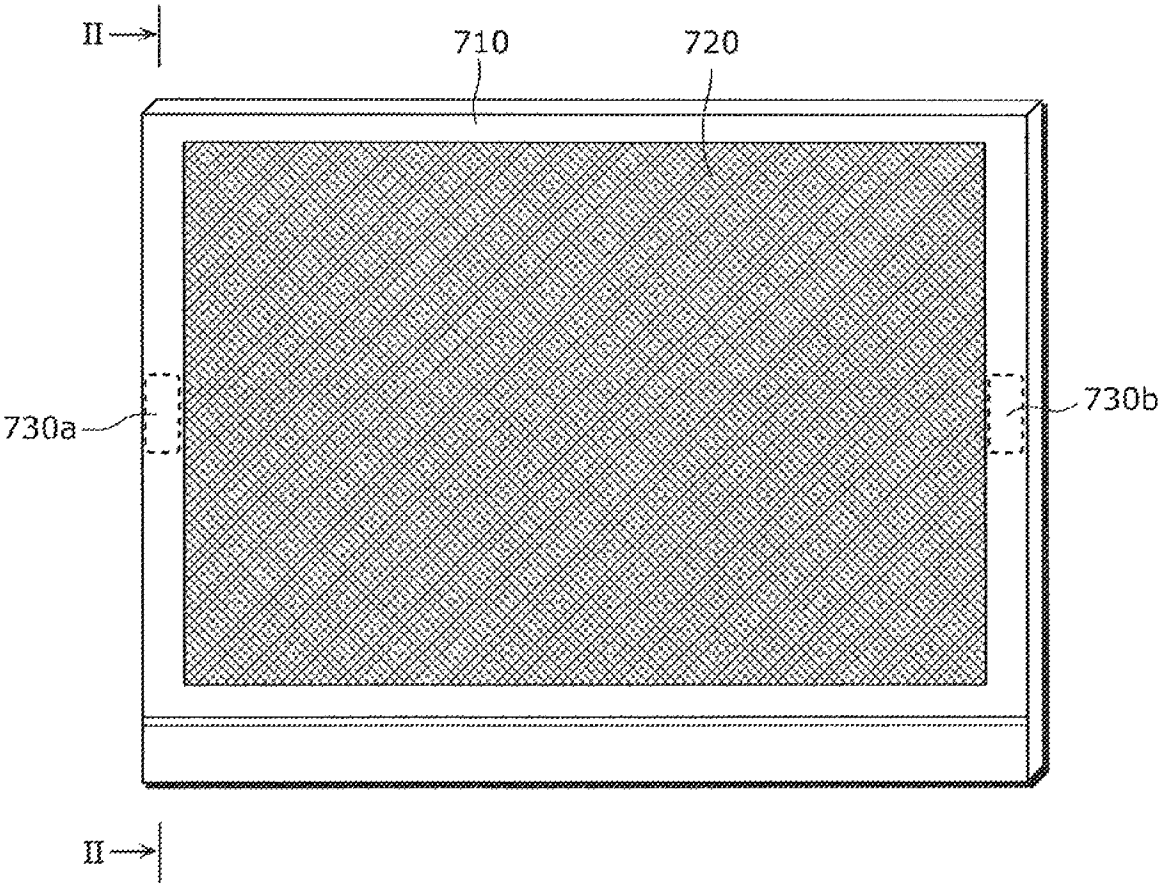
FIG. 25 is an external view of an acoustic video device to which the piezoelectric speaker according to each of the embodiments of the present invention is applied.

FIG. 25 is an external view of an acoustic video device 700 to which the piezoelectric speaker according to each of the embodiments of the present invention is applied. The acoustic video device 700, as shown in FIG. 25, includes: a device chassis 710; a display 720 provided in a center portion of the front face of the device chassis 710; and piezoelectric speakers 730*a* and 730*b* according to the present invention which are provided in both right and left end portions of the front face of the device chassis 710.

The acoustic video device 700, for example, is a flat television such as a liquid crystal display, a plasma display, or an organic electroluminescence (EL) display, and as such has a very small depth. This means a narrow space for housing the piezoelectric speaker 730*a* and 730*b*. As a result, in a conventional electrodynamic speaker, the displacement of the diaphragm is mechanically constrained as well as the movement of the diaphragm being obstructed due to the influence of the air in the back side, thus making it difficult to reproduce bass sound.

Here, use of the piezoelectric speaker and the chassis configuration according to the first to the six embodiment allows reproducing the bass sound range even with the piezoelectric speakers 730*a* and 703*b* housed in the device chassis 710 whose internal thickness is small. For example, when assuming that FIG. 2 shows a cross section taken along II-II in FIG. 25, even a limited space inside the device chassis 710 allows a large displacement of the diaphragm, thus allowing satisfactory reproduction of the bass sound range and providing, as a result, sound content which is highly consistent with video images.

8. Embodiment 8

Second Application Example

Figure 26:
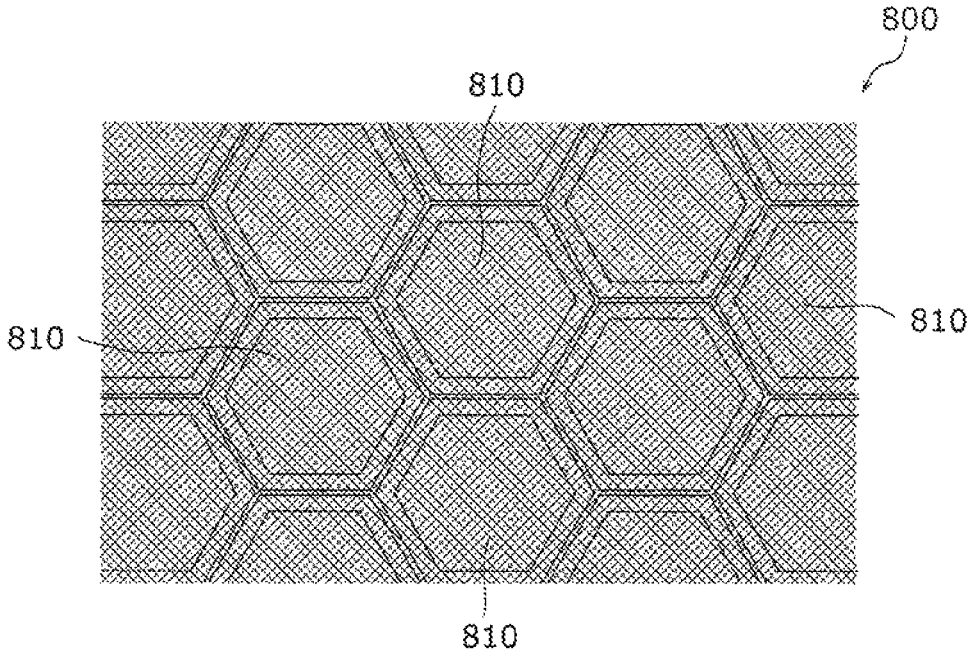
FIG. 26 is a schematic view showing a part of an array speaker module to which the piezoelectric speaker according to each of the embodiments of the present invention is applied.
Figure 27:
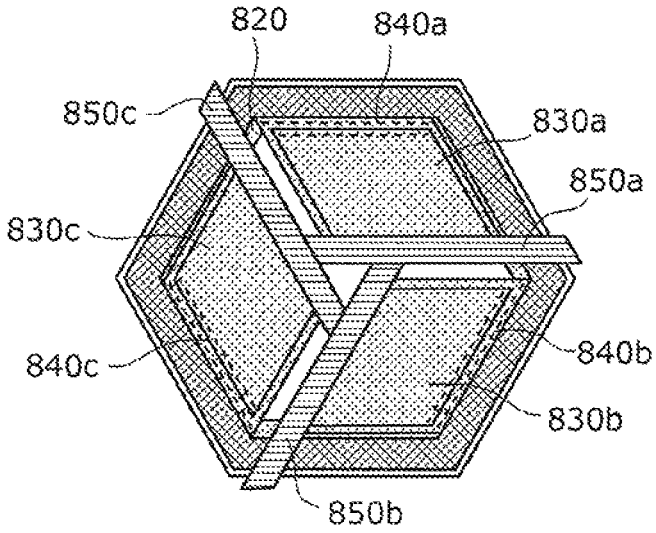
FIG. 27 is a diagram of a piezoelectric speaker unit as viewed from a back side.
Figure 28:
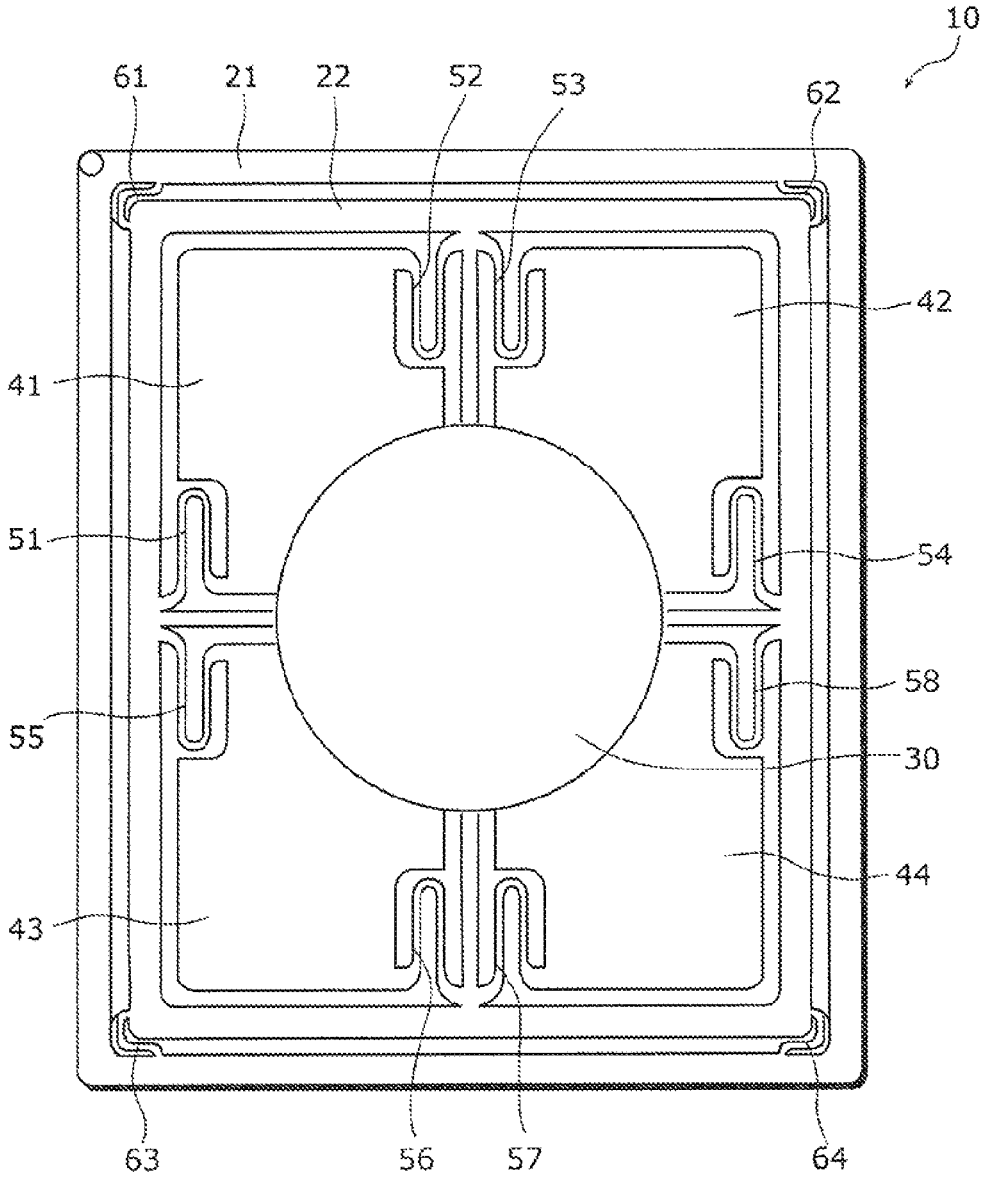
FIG. 28 is an external view of a conventional piezoelectric speaker.

FIG. 26 is a schematic view showing a part of an array speaker module 800 to which the piezoelectric speaker according to each of the embodiments of the present invention is applied. FIG. 27 is a diagram of a piezoelectric speaker unit 810 as viewed from the back side.

The array speaker module 800, as shown in FIG. 26, is configured by combining a plurality of piezoelectric speaker units 810. More specifically, each of the piezoelectric speaker units 810 has an approximately hexagonal shape, and is provided such that adjacent ones of the piezoelectric speaker units 810 share a side with each other.

In the piezoelectric speaker unit 810, the edge 861 is connected to a circumferential portion of the first piezoelectric diaphragm 820 that functions as the sound wave radiating surface. The first piezoelectric diaphragm 820 is connected to the second piezoelectric diaphragms 830*a*, 830*b*, and 830*c* via, respectively, joint members 840*a*, 840*b*, and 840*c* indicated by dotted lines. The second piezoelectric diaphragms 830*a*, 830*b*, and 830*c* are fixed to a chassis (whose illustration is omitted) via, respectively, fixing members 850*a*, 850*b*, and 850*c*. In addition, the three fixing members 850*a* to 850*c* are integrally connected to each other at one end, at a position facing a center portion of the first piezoelectric diaphragm 820, and each of the three fixing members is connected, at the other end, to an external frame which is not shown in the figure.

Here, in an eighth embodiment, unlike the first to the seventh embodiments, the first piezoelectric diaphragm 820 and the second piezoelectric diaphragms 830*a*, 830*b*, and 830*c* are arranged to face each other. This allows arrangement of the plurality of piezoelectric speaker units 810 at minimum spacing, without requiring a mounting area which exceeds the area of the sound wave radiation region. This, as a result, allows faithfully reproducing a sound field expected of the array speaker module units 800 in a wider frequency range.

Note that in the seventh and eighth embodiments, some examples have been shown where the piezoelectric speaker according to the present invention is applied for reproducing acoustic content at home. However, the use of the piezoelectric speaker according to the present invention is not limited to the domestic use but may be applied to, for example, an in-vehicle audio system or an alarm system for a passenger transport means, which is expected to be thinner and lighter and is also expected to be more compatible with bass reproduction. In addition, the size of the piezoelectric speaker according to the present invention is not limited to the size for incorporation as a woofer of a normal audiovisual (AV) device or a mid-range speaker, but may also be applied to a speaker corresponding to a size ranging from a size independently adopted as a subwoofer to a small size such as earphones or a receiver.

Note that in the embodiments above, some application examples of the present invention as a piezoelectric speaker for radiating a sound wave into the air have been described. However, the present invention is not limited to the use for radiating the sound wave into the air, but may be used, for example, as an actuator which controls the vibration of a structure or controls, indirectly, the vibration of a solid or fluid by acoustic vibration.

In addition, in the embodiments above, the present invention has been described as a means for converting an electric signal into a mechanical vibration and a sound wave. However, the present invention may also be applied to another piezoelectric transducer, and may be applied to a sensor, and a microphone.

Thus far, the embodiments of the present invention have been described with reference to the drawings, but the present invention is not limited to the embodiments that have been illustrated. Of the illustrated embodiments, various modifications and variations are possible within the same or equivalent scope of the present invention.

The present invention is applicable to a piezoelectric acoustic transducer and so on, and is particularly useful for balancing between space saving and improvement in bass reproduction ability, or for preventing sound quality deterioration due to an influence of a speaker cabinet.

REFERENCE NUMERAL LIST

10, 100, 200, 300, 400, 500, 600, 730*a*, 730*b* Piezoelectric speaker
21 Outer frame
22 Inner frame
30, 122, 123, 132*a*, 132*b*, 133*a*, 133*b*, 582, 583, 584, 585 Piezoelectric element
41, 42, 43, 44, 370, 570, 670 Diaphragm
51, 52, 53, 54, 55, 56, 57, 58 Damper
61, 62, 63, 64 Edge
110, 210, 610 Chassis
120, 420, 820 First piezoelectric diaphragm
121, 131*a*, 131*b*, 581 Substrate
130*a*, 130*b*, 430*a*, 430*b*, 430*c*, 430*d*, 430*e*, 430*f*, 830*a*, 830*b*, 830*c* Second piezoelectric diaphragm
140*a*, 140*b*, 140*c*, 140*d*, 140*e*, 140*f*, 141*a*, 142*a*, 840*a*, 840*b*, 840*c* Joint member
150*a*, 150*b*, 150*c*, 150*d*, 150*e*, 150*f*, 250*a*, 250*b*, 850*a*, 850*b*, 850*c* Fixing member
161, 861 Edge
162 Radiation plate protection film
270*a*, 270*b* Filling material
371, 372, 571, 671 Connection member
580*a*, 580*b* Third piezoelectric diaphragm
700 Acoustic video device
710 Device chassis
720 Display
800 Array speaker module
810 Piezoelectric speaker unit

The invention claimed is:

1. A piezoelectric acoustic transducer, comprising:

a chassis having a wall surface including an opening;

a plurality of diaphragms including at least a first piezoelectric diaphragm and a second piezoelectric diaphragm which vibrate in phases opposite to each other when a voltage is applied to each of said first and second piezoelectric diaphragms; and a joint member which connects said first and second piezoelectric diaphragms in a positional relationship such that said first and second piezoelectric diaphragms are located at positions different from each other in a thickness direction, wherein one of said diaphragms is provided, in the opening of said chassis, so as to have one surface facing an outside of said chassis and another surface facing an inside of said chassis, the one of said diaphragms functions as a radiation plate which radiates a sound wave by vibrating at an amplitude generated by synthesizing amplitudes of said first and second piezoelectric diaphragms, and each of said first and second piezoelectric diaphragms includes:

a substrate; and a piezoelectric element which is provided on at least one of a top face and a reverse face of said substrate, and expands or contracts when a voltage is applied to said piezoelectric element.

2. The piezoelectric acoustic transducer according to claim 1, wherein the one diaphragm provided in the opening of said chassis is said first piezoelectric diaphragm, and said second piezoelectric diaphragm is housed inside said chassis.

3. A piezoelectric acoustic transducer comprising:

a chassis having a wall surface including an opening;

a first piezoelectric diaphragm and a second piezoelectric diaphragm which vibrate in phases opposite to each other when a voltage is a lied to each of said first and second piezoelectric diaphragms; and a joint member which connects said first and second piezoelectric diaphragms in a positional relationship such that said first and second piezoelectric diaphragms are located at positions different from each other in a thickness direction;

a diaphragm disposed at the opening of said chassis and functioning as a radiation plate, said diaphragm being connected to said first piezoelectric diaphragm, wherein said diaphragm is provided, in the opening of said chassis, so as to have one surface facing an outside of said chassis and another surface facing an inside of said chassis, said diaphragm functions as a radiation plate which radiates a sound wave by vibrating at an amplitude generated by synthesizing amplitudes of said first and second piezoelectric diaphragms, wherein said diaphragm radiates a sound wave by vibrating at an amplitude generated by synthesizing amplitudes of said first and second piezoelectric diaphragms, wherein said diaphragm is connected to said first piezoelectric diaphragm at a position such that said diaphragm is located at a position different from said first piezoelectric diaphragm in the thickness direction, and said diaphragm vibrates at the synthesized amplitude transmitted from said first piezoelectric diaphragm, and wherein said first and second piezoelectric diaphragms are housed inside said chassis.

4. The piezoelectric acoustic transducer according to claim 3, wherein said diaphragm and said first piezoelectric diaphragm are placed so as to face each other, and said diaphragm is connected to said first piezoelectric diaphragm via a connection member which connects said diaphragm to said first piezoelectric diaphragm at a point at which an amplitude of said first piezoelectric diaphragm is maximum.

5. The piezoelectric acoustic transducer according to claim 2, further comprising a fixing member for fixing said second piezoelectric diaphragm to an inner wall surface of said chassis.

6. The piezoelectric acoustic transducer according to claim 2, further comprising a fixing member which is extended toward the outside and the inside of said chassis through a space provided in said chassis, and fixes said second piezoelectric diaphragm to a rigid body outside said chassis.

7. The piezoelectric acoustic transducer according to claim 1, wherein each of said first and second piezoelectric diaphragms has an approximately rectangular shape having a long side and a short side, and said joint member is a long member which extends along the short side of each of said first and second piezoelectric diaphragms, and connects the short side of said first piezoelectric diaphragm to the short side of said second piezoelectric diaphragm.

8. The piezoelectric acoustic transducer according to claim 1, wherein each of said first and second piezoelectric diaphragms has an approximately rectangular shape, and said joint member connects each of corner portions of said first piezoelectric diaphragm to a corresponding one of corner portions of said second piezoelectric diaphragms.

9. The piezoelectric acoustic transducer according to claim 1, wherein bending rigidity of said joint member is larger in a direction that intersects with a main surface of the one of said diaphragms, which functions as the radiation plate, than bending rigidity in a main surface direction of said first and second piezoelectric diaphragms.

10. The piezoelectric acoustic transducer according to claim 1, wherein a line for connecting a signal source and said piezoelectric element is printed on a face of said substrate, on which said piezoelectric element is provided.

11. The piezoelectric acoustic transducer according to claim 10, wherein the line is extended from the signal source to one of said first and second piezoelectric diaphragms via the other of said first and second piezoelectric diaphragms, and conducts electricity between said piezoelectric element of said first piezoelectric diaphragm and said piezoelectric element of said second piezoelectric diaphragm.

12. The piezoelectric acoustic transducer according to claim 11, wherein the line is extended to the one of said first and second piezoelectric diaphragms via the other of said first and second piezoelectric diaphragms, through a through hole that is formed in a surface or inside of said joint member.

13. The piezoelectric acoustic transducer according to claim 1, further comprising a filling member which is made of a flexible material and fills a space between the one of said diaphragms, which functions as the radiation plate, and the opening of said chassis.

* * * * *